US012173618B2

(12) United States Patent
Spangler et al.

(10) Patent No.: US 12,173,618 B2
(45) Date of Patent: Dec. 24, 2024

(54) AIRFOILS WITH LOBED COOLING CAVITIES

(71) Applicant: RTX Corporation, Farmington, CT (US)

(72) Inventors: Brandon W. Spangler, Vernon, CT (US); David R. Pack, Gold Canyon, AZ (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 18/372,955

(22) Filed: Sep. 26, 2023

(65) Prior Publication Data

US 2024/0102391 A1 Mar. 28, 2024

Related U.S. Application Data

(60) Provisional application No. 63/411,514, filed on Sep. 29, 2022, provisional application No. 63/410,180, filed on Sep. 26, 2022.

(51) Int. Cl.
*F01D 5/18* (2006.01)

(52) U.S. Cl.
CPC ..... *F01D 5/18* (2013.01)

(58) Field of Classification Search
CPC ..... F01D 5/18
See application file for complete search history.

(56) References Cited

U.S. PATENT DOCUMENTS 5,156,526 A 10/1992 Lee et al.
5,246,340 A 9/1993 Winstanley et al.
5,296,308 A 3/1994 Caccavale et al.
6,206,638 B1 3/2001 Glynn et al.
6,609,884 B2 * 8/2003 Harvey ..... F01D 5/187 415/115
6,626,230 B1 9/2003 Woodrum et al.
7,131,818 B2 11/2006 Cunha et al.
7,141,812 B2 11/2006 Appleby et al.
(Continued)

FOREIGN PATENT DOCUMENTS

EP 3002070 B1 2/2019
EP 4170130 A2 4/2023
(Continued)

OTHER PUBLICATIONS

Partial Search Report and Written Opinion dated Dec. 21, 2023 for European Patent Application No. 23199539.0.
(Continued)

*Primary Examiner* — Sabbir Hasan
(74) *Attorney, Agent, or Firm* — Bachman & LaPointe, P.C.

(57) ABSTRACT

A turbine engine airfoil element has a plurality of main body passageways along a camber line and having two or more chordwise distributed protuberant portions with necks between the protuberant portions. A plurality of skin passageways include: at least one first skin passageway each nested between a first of the pressure side and the suction side and two adjacent main body passageways; and a plurality of second skin passageways each nested between first of the pressure side and the suction side and two said protuberant portions of a corresponding main body passageway.

20 Claims, 14 Drawing Sheets

(56) References Cited

U.S. PATENT DOCUMENTS

| | | | | |
|---|---|---|---|---|
| 7,217,092 | B2 * | 5/2007 | Lee | F01D 5/187 416/97 R |
| 7,293,961 | B2 | 11/2007 | Lee et al. | |
| 7,871,245 | B2 | 1/2011 | Pietraszkiewicz et al. | |
| 9,272,324 | B2 | 3/2016 | Merrill et al. | |
| 9,995,149 | B2 * | 6/2018 | Foster | F01D 5/187 |
| 10,166,599 | B2 * | 1/2019 | Castle | B22C 3/00 |
| 10,207,315 | B2 | 2/2019 | Appleby et al. | |
| 10,378,364 | B2 | 8/2019 | Spangler et al. | |
| 10,605,090 | B2 * | 3/2020 | Leary | F01D 9/02 |
| 10,871,074 | B2 | 12/2020 | Spangler et al. | |
| 11,111,857 | B2 | 9/2021 | Spangler | |
| 11,149,550 | B2 | 10/2021 | Spangler et al. | |
| 11,220,912 | B2 * | 1/2022 | Spangler | F01D 5/187 |
| 11,629,602 | B2 * | 4/2023 | Spangler | F01D 5/187 415/115 |
| 11,905,849 | B2 * | 2/2024 | Spangler | F01D 5/147 |
| 2007/0059172 | A1 | 3/2007 | Lee et al. | |
| 2015/0118057 | A1 | 4/2015 | Lee et al. | |
| 2016/0067769 | A1 * | 3/2016 | Wilson | B22C 9/103 164/271 |
| 2020/0347734 | A1 | 11/2020 | Spangler et al. | |
| 2021/0324741 | A1 | 10/2021 | Spangler | |
| 2022/0403746 | A1 | 12/2022 | Spangler et al. | |

FOREIGN PATENT DOCUMENTS

| | | | |
|---|---|---|---|
| JP | 2017503656 | A | 2/2017 |
| WO | 2016/122483 | A1 | 8/2016 |

OTHER PUBLICATIONS

Extended European Search Report and Written Opinion dated Mar. 19, 2024 for European Patent Application No. 23199539.0.

* cited by examiner

AIRFOILS WITH LOBED COOLING CAVITIES

CROSS-REFERENCE TO RELATED APPLICATION

Benefit is claimed of U.S. Patent Application No. 63/410,180, filed Sep. 26, 2022, and entitled "Airfoils with Lobed Cooling Cavities", and U.S. Patent Application No. 63/411,514, filed Sep. 29, 2022, and entitled "Airfoils with Lobed Cooling Cavities", the disclosures of which are incorporated by reference herein in their entireties as if set forth at length.

BACKGROUND

The disclosure relates to gas turbine engines. More particularly, the disclosure relates to airfoil cooling passageways and their manufacture.

Gas turbine engines (used in propulsion and power applications and broadly inclusive of turbojets, turboprops, turbofans, turboshafts, industrial gas turbines, and the like) internally-cooled hot section components. Key amongst these components are turbine section blades and vanes (collectively airfoil elements). Such cooled airfoil elements typically include generally spanwise/radial feed passageways with outlets (e.g., film cooling outlets) along the external surface of the airfoil. In typical designs, the feed passageways are arrayed streamwise along the camber line between the leading edge and the trailing edge. In many airfoils, along the leading edge there is an impingement cavity fed by a leading feed passageway. Similarly, there may be a trailing edge discharge slot fed by a trailing feed passageway.

In various situations, the number of spanwise passageways may exceed the number of feed passageways if one of the passageways serpentines (e.g., a blade passageway having an up-pass leg from the root, a turn near the tip, and then a down-pass leg heading back toward the root). In some such implementations, the down-pass may, for example, feed the trailing edge discharge slot.

Whereas blades will have cooling passageway inlets along their roots (e.g., dovetail or firtree roots) with feed passageway trunks extending spanwise/radially outward from the root and into the airfoil, depending on implementation, vanes may more typically have inlets along an outer diameter (OD) shroud so that the feed passageways extend spanwise/radially inward.

However, there are alternatives including cantilevered vanes mounted at their outer diameter ends (e.g., for counter-rotating configurations) and the like.

U.S. Pat. No. 5,296,308, Mar. 22, 1994, to Caccavale et al. and entitled "Investment Casting Using Core with Integral Wall Thickness Control Means", (the '308 patent), shows a ceramic feedcore having spanwise sections for casting associated passageways. Additionally, the sections have protruding bumpers to space the feedcore centrally within an investment die for overmolding.

Additional forms of airfoil elements lack the traditional single grouping of upstream-to-downstream spanwise passages along the camber or mean line of the airfoil. Instead, walls separating passages may have a lattice-like structure when viewed in a radially inward or outward view.

One example includes U.S. Pat. No. 10,378,364, Aug. 13, 2019, to Spangler et al. and entitled "Modified Structural Truss for Airfoils", (the '364 patent), the disclosure of which is incorporated by reference herein in its entirety as if set forth at length. Viewed in a spanwise/radial inward or outward section, the '364 patent shows a streamwise series of main air passageways falling along the camber or mean line. In a particular illustrated example, three of those passageways have approximately a rounded-corner convex quadrilateral cross-section/footprint with an opposite pair of corners falling approximately along the camber line so that the leading corner of one passageway is adjacent the trailing corner of another.

Along the pressure and suction side, a series of respective rounded-corner triangular cross-section passageways (skin passageways) alternate with the main passageways with a base of the triangle approximately parallel to and spaced apart from the adjacent pressure or suction side and the opposite corner of the triangle pointed inward to create thin walls between such triangular passageway and the adjacent two main passageways. Depending upon implementation, the '364 configuration may be cast by a ceramic casting core assembly where a main feedcore forms the main passageways and any additional adjacent passageways falling along the camber line. A pressure side core and a suction side core may form the respective associated triangular passageways. Each such pressure side core or suction side core may have spanwise triangular section segments linked by core tie sections at spanwise intervals.

In some embodiments, the main passageways and the skin passageways may extend all the way to associated inlets (e.g., at an ID face of a blade root). In some embodiments, they remain intact/discrete all the way from the inlets and into the airfoil. In other embodiments, various of the passageways may merge (merger being viewed in the upstream direction of airflow through the passageways; with the passageways branching from trunks when viewed in the downstream airflow direction). One example of discrete intact passageways from inlets in a root is shown in U.S. Pat. No. 11,149,550, Oct. 19, 2021, to Spangler et al. and entitled "Blade neck transition", (the '550 patent), the disclosure of which is incorporated by reference herein in its entirety as if set forth at length.

Another example of passageway layout is shown in U.S. Pat. No. 11,111,857, Sep. 7, 2021, to Spangler and entitled "Hourglass airfoil cooling configuration", (the '857 patent), the disclosure of which is incorporated by reference herein in its entirety as if set forth at length.

SUMMARY

One aspect of the disclosure involves a turbine engine airfoil element comprising: an airfoil having: a pressure side and a suction side; and a plurality of spanwise passageways including: a plurality of main body passageways along a camber line and having two or more chordwise distributed protuberant portions with necks between the protuberant portions; and a plurality of skin passageways including: at least one first skin passageway each nested between a first of the pressure side and the suction side and two adjacent main body passageways; and a plurality of second skin passageways each nested between first of the pressure side and the suction side and two said protuberant portions of a corresponding main body passageway.

In a further embodiment of any of the foregoing embodiments, additionally and/or alternatively, viewed normal to the first side, each skin passageway overlaps its adjacent main body passageway depthwise preferably by a distance ($D_{O1}$, $D_{O2}$) of at least 0.030 inch (0.76 mm), optionally 0.030 inch to 0.200 inch (0.76 mm to 5.1 mm), optionally over at least 50% of an airfoil span and/or optionally over at least 70% of the inboard 70% of the airfoil span.

In a further embodiment of any of the foregoing embodiments, additionally and/or alternatively, the first side is the suction side (so that the plurality of skin passageways are suction side passageways) and the plurality of spanwise passageways further include a plurality of pressure side passageways including: at least one first pressure side passageway each nested between the pressure side and two adjacent main body passageways; and a plurality of second pressure side passageways each nested between the pressure side and two said protuberant portions of a corresponding main body passageway. Additional features and aspects discussed below for embodiments having both pressure side and suction side skin passageways may be applied to those having such skin passageways only one of the two sides.

In a further embodiment of any of the foregoing embodiments, additionally and/or alternatively, the pressure side passageways and the suction side passageways have rounded-corner triangular cross-section.

In a further embodiment of any of the foregoing embodiments, additionally and/or alternatively, each of the protuberant portions has a rounded-corner quadrilateral planform.

In a further embodiment of any of the foregoing embodiments, additionally and/or alternatively, there are four to ten said pressure side passageways and four to ten said suction side passageways.

In a further embodiment of any of the foregoing embodiments, additionally and/or alternatively: adjacent pressure side passageways connect to each other via a plurality of linking passageways; adjacent suction side passageways connect to each other via a plurality of linking passageways; and the linking passageways extend less deeply into the airfoil cross-section than do the adjacent pressure or suction side passageways.

In a further embodiment of any of the foregoing embodiments, additionally and/or alternatively: the necks extend over at least 50% of a span of the airfoil or at least 80% optionally continuously; and the necks have a section within 10° of parallel to the respective adjacent pressure side or suction side and preferably having an axial length $L_N$ between the airfoil leading edge and trailing edge of at least 0.030 inch (0.76 mm).

In a further embodiment of any of the foregoing embodiments, additionally and/or alternatively, multiple of the second pressure side passageways and multiple of the second suction side passageways have: one or more outboard projections into the respective pressure side wall or suction side wall; and one or more inboard projections into a wall shared with the associated neck.

In a further embodiment of any of the foregoing embodiments, additionally and/or alternatively, the second pressure side passageways and the second suction side passageways have a pair of side surfaces forming respective walls with adjacent surfaces of the associated protuberant portions, said walls having a central section diverging in thickness toward the camber line or mean line of the airfoil by an angle $\theta_4$ of 3.0° to 10.0°, preferably over the entire overlapping spanwise dimension of the passageways within the airfoil, but at least over a radial spanwise dimension of 0.100 inch (2.54 mm) adjacent to each inboard projection from the pressure or suction side passageways.

In a further embodiment of any of the foregoing embodiments, additionally and/or alternatively: each of the second pressure side passageways (or each having said projections or just multiple of) have at least two said outboard projections and at least two said inboard projections; and each of the second suction side passageways (or each having said projections or just multiple of) have at least two said outboard projections and at least two said inboard projections.

In a further embodiment of any of the foregoing embodiments, additionally and/or alternatively: most of the outboard projections do not penetrate the respective pressure side wall or suction side wall; and most of the inboard projections into the shared wall do not penetrate.

In a further embodiment of any of the foregoing embodiments, additionally and/or alternatively, the turbine engine airfoil element is a blade having an attachment root: the main body passageways extend from respective inlets at an inner diameter (ID) end of the root; and the first and second pressure side passageways and first and second suction side passageways extend from respective inlets at the inner diameter (ID) end of the root.

In a further embodiment of any of the foregoing embodiments, additionally and/or alternatively, a turbine engine including the turbine engine airfoil.

In a further embodiment of any of the foregoing embodiments, additionally and/or alternatively, the turbine engine airfoil element is a turbine section blade or vane.

In a further embodiment of any of the foregoing embodiments, additionally and/or alternatively, a method for manufacturing the turbine engine airfoil comprises assembling to each other: a ceramic feedcore having sections for forming the plurality of main body passageways; a ceramic pressure side skin core having sections for forming the plurality of pressure side passageways; and a ceramic suction side skin core having sections for forming the plurality of suction side passageways. The method further includes: overmolding the assembly with a fugitive; shelling the fugitive to form a shell; casting alloy in the shell; and deshelling and decoring the cast alloy.

In a further embodiment of any of the foregoing embodiments, additionally and/or alternatively, the fugitive is wax and the shell is dewaxed prior to the casting.

In a further embodiment of any of the foregoing embodiments, additionally and/or alternatively: the pressure side skin core has a plurality of outward projections from associated said sections and a plurality of inward projections from associated said sections; and the suction side skin core has a plurality of outward projections from associated said sections and a plurality of inward projections from associated said sections.

In a further embodiment of any of the foregoing embodiments, additionally and/or alternatively, the method further comprising: molding the feedcore, the pressure side skin core, and the suction side skin core of ceramic material. The molded cores may be fired prior to the assembly.

In a further embodiment of any of the foregoing embodiments, additionally and/or alternatively: along one of the pressure side skin core sections, one or more of the inward projections have substantially less play in the assembly than the inboard projections of all other sections of the pressure side skin core, preferably, less than half the play radially and/or transverse thereto; and/or along one of the suction side skin core sections, one or more of the inward projections have substantially less play in the assembly than the inboard projections of all other sections of the suction side skin core less than half the play radially and/or transverse thereto.

In a further embodiment of any of the foregoing embodiments, additionally and/or alternatively, during the casting, for both the pressure side skin core and the suction side skin core, some of the inward projections do not contact the feedcore.

In a further embodiment of any of the foregoing embodiments, additionally and/or alternatively, prior to decoring: one or more of the plurality of inward projections of the pressure side skin core each extend further into the airfoil to nest within a respective pocket on the pressure side of a portion of the feedcore section that casts the neck of the associated main body passageway; and one or more of the plurality of inward projections of the suction side skin core each extend further into the airfoil to nest within a respective pocket on the suction side of the portion of the feedcore section that casts the neck of the associated main body passageway.

In a further embodiment of any of the foregoing embodiments, additionally and/or alternatively: on the pressure side there is a single said pocket which is located on a main body passageway closest to the axial center of the pressure side skin core; and on the suction side there is a single said pocket which is located on a main body passageway closest to the axial center of the suction side skin core.

In a further embodiment of any of the foregoing embodiments, additionally and/or alternatively: the feedcore sections each have a spanwise pressure side channel and a spanwise suction side channel that cooperate to cast the necks; and the spanwise pressure side channel and the spanwise suction side channel have flat base portions extending within 10° of parallel to the adjacent airfoil pressure side or suction side over a streamwise span $L_N$ of at least 0.030 inch (0.76 mm).

A further aspect of the disclosure involves a skin core for casting passageway segments adjacent a wall of a casting. The skin core comprises: a plurality of core segments for casting respective said passageway segments; a plurality of core ties linking adjacent core segments; a plurality of first bumpers protruding from the base portions of associated segments; and a plurality of second bumpers protruding from the inboard rounded corner. Each core segment has a generally rounded-corner triangular cross section with: a flat base portion extending within 10° of parallel to the adjacent external wall surface over a span of at least 0.050 inch (1.27 mm) transverse to a longitudinal direction of the core segment; an inboard rounded corner; and lateral sides converging toward the inboard corner.

In a further embodiment of any of the foregoing embodiments, additionally and/or alternatively: a single one of the second bumpers protrudes at least 0.012 inch (0.305 mm) further than the other second bumpers within a radial distance of 20% of the airfoil span therefrom; and the single one is within a streamwise middle third of the skin core and a spanwise outboard quarter.

In a further embodiment of any of the foregoing embodiments, additionally and/or alternatively, a method for manufacturing the skin core comprises: injecting ceramic into a die having a first half and a second half; and linearly separating the first half from the second half.

In a further embodiment of any of the foregoing embodiments, additionally and/or alternatively, viewed in section normal to a length of at least one of the segments, the flat base portion of that segment is within 10° of normal to the direction of linear separation.

A further aspect of the disclosure involves a casting core assembly comprising: a first casting core including: a plurality of segments having in transverse section two or more lobes joined by respective necks; and a second casting core including. The second casting core includes: a plurality of segments including in transverse section: at least one first segment each nested partially between two adjacent first casting cores; and a plurality of second segments each nested partially between two said protuberant lobes of a corresponding first casting core.

In a further embodiment of any of the foregoing embodiments, additionally and/or alternatively, each second casting core segment has a generally rounded-corner triangular or trapezoidal cross section with: a flat base portion away from the first casting core; and a pair of sides converging toward the first casting core. A plurality of core ties link adjacent second casting core segments. A plurality of first bumpers protrude from the base portions of associated second casting segments. A plurality of second bumpers protrude from second casting core second segments toward the neck of the respective associated first casting core.

In a further embodiment of any of the foregoing embodiments, additionally and/or alternatively: the necks of the first casting core have a section within 10° of parallel to the flat base portion of the nested second casting core second segment over an axial length $L_N$ of at least 0.030 inch (0.76 mm); and/or a cross-section of the at least one second segment includes an inboard rounded corner adjacent to an adjacent said neck and the plurality of second bumpers protrude from the inboard rounded corner.

In a further embodiment of any of the foregoing embodiments, additionally and/or alternatively: a single one of the second bumpers of the second casting core protrudes into a pocket of the neck of the associated first casting core; and/or each second segments has multiple first bumpers and multiple second bumpers; and/or each first segments lacks bumpers.

In a further embodiment of any of the foregoing embodiments, additionally and/or alternatively, the single one of the second bumpers of the second casting core is within an axial middle third of the skin core and a spanwise outboard quarter.

In a further embodiment of any of the foregoing embodiments, additionally and/or alternatively, the first casting core lobes are rounded-corner convex quadrilateral in cross-section with each neck having respective junctions with the associated lobes replacing one corner of each quadrilateral and a third casting core, on an opposite side of the first casting core from the second casting core includes a plurality of segments including in transverse section: at least one first segment each nested partially between two adjacent first casting cores; and a plurality of second segments each nested partially between two said protuberant lobes of a corresponding first casting core.

In a further embodiment of any of the foregoing embodiments, additionally and/or alternatively, the casting core assembly is configured for casting a blade having an airfoil wherein: each third casting core segment has a generally rounded-corner triangular or trapezoidal cross section with a flat base portion away from the first casting core and a pair of sides converging toward the first casting core; a plurality of core ties link adjacent second casting core segments; a plurality of first bumpers protrude from the base portions of associated second casting segments; and a plurality of second bumpers protrude from second casting core second segments toward the neck of the respective associated first casting core; the necks fall along a chord of the airfoil. For each of the second casting core and the third casting core: the segments extend spanwise; the first bumpers of a given segment protrude within 10° of opposite to the second bumpers of the same segments; and the first bumpers and second bumpers taper proximally to distally and optionally have rounded tips.

In a further embodiment of any of the foregoing embodiments, additionally and/or alternatively, the second casting core is a skin core for casting passageways along or adjacent a surface of a casting. The first casting core and the second casting core provide means for registering the second casting core relative to the first casting core, the means decoupling relative core movement normal to the casting surface from relative core movement parallel to the casting surface.

The details of one or more embodiments are set forth in the accompanying drawings and the description below. Other features, objects, and advantages will be apparent from the description and drawings, and from the claims.

Some of the sectional views selectively show out of plane features for purposes of illustration.

Like reference numbers and designations in the various drawings indicate like elements.

DETAILED DESCRIPTION

The detailed description of example embodiments herein makes reference to the accompanying drawings, which show example embodiments by way of illustration and their best mode. While these example embodiments are described in sufficient detail to enable those skilled in the art to practice the inventions, it should be understood that other embodiments may be realized and that logical, chemical and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact. Where used herein, the phrase "at least one of A or B" can include any of "A" only, "B" only, or "A and B."

Figure 1:
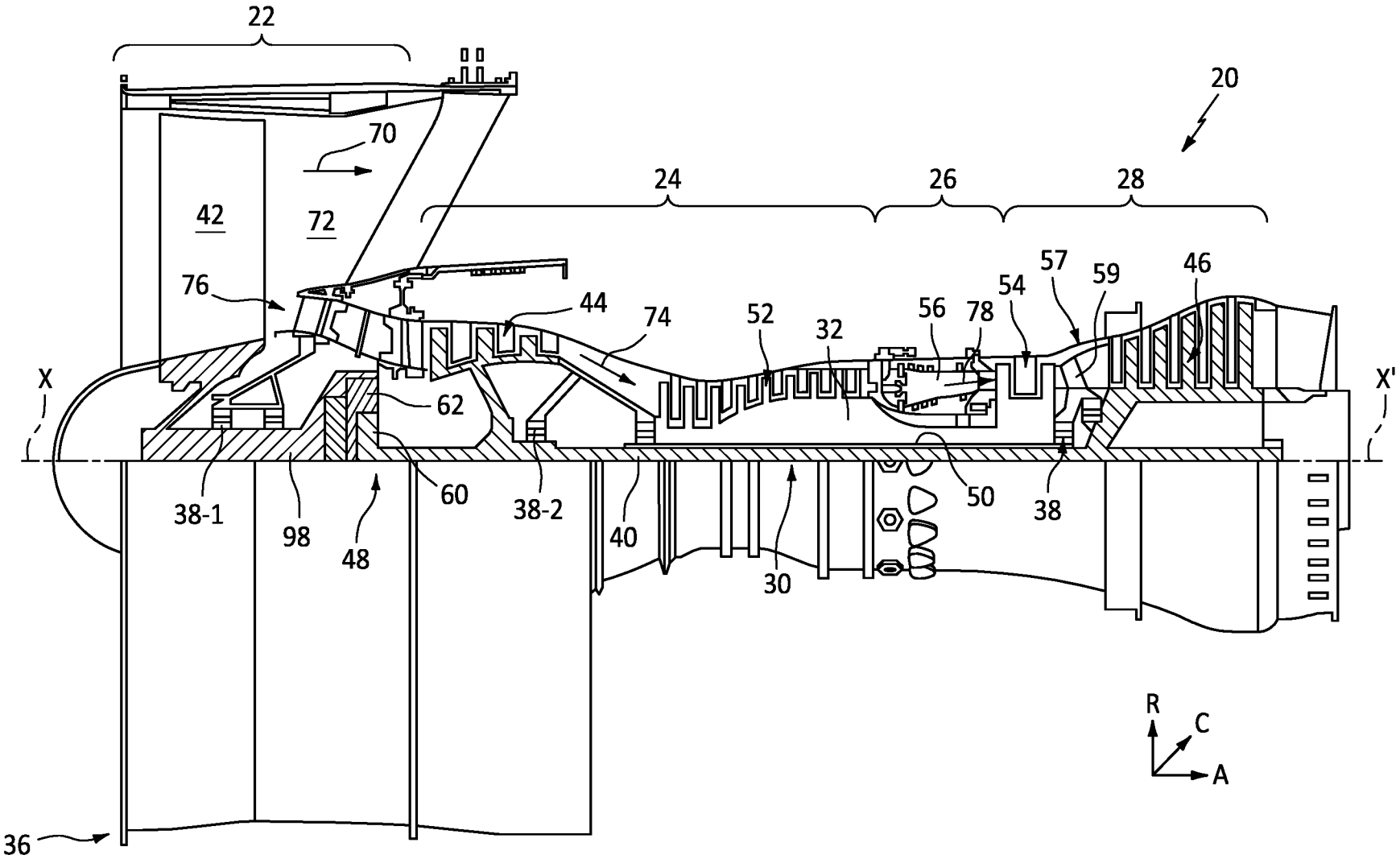
FIG. 1 is a cross-sectional view of an example gas turbine engine, in accordance with various embodiments.

With reference to FIG. 1, a gas turbine engine 20 is provided. As used herein, "aft" refers to the direction associated with the tail (e.g., the back end) of an aircraft, or generally, to the direction of exhaust of the gas turbine engine. As used herein, "forward" refers to the direction associated with the nose (e.g., the front end) of an aircraft, or generally, to the direction of flight or motion. As utilized herein, radially inward refers to the negative R direction and radially outward refers to the R direction. An A-R-C axis is shown throughout the drawings to illustrate the relative position of various components.

The gas turbine engine 20 may be a two-spool turbofan that generally incorporates a fan section 22, a compressor section 24, a combustor section 26 and a turbine section 28. In operation, the fan section 22 drives air 70 along a bypass flow-path 72 while the compressor section 24 drives air 74 along a core flow-path 76 for compression and communication into the combustor section 26 then expansion of combustion gas 78 through the turbine section 28. Although depicted as a turbofan gas turbine engine 20 herein, it should be understood that the concepts described herein are not limited to use with turbofans as the teachings may be applied to other types of turbine engines including three-spool architectures and turboshaft or industrial gas turbines with one or more spools.

The gas turbine engine 20 generally comprise a low speed spool 30 and a high speed spool 32 mounted for rotation about an engine central longitudinal axis X-X' relative to an engine static structure 36 via several bearing systems 38, 38-1, and 38-2. It should be understood that various bearing systems 38 at various locations may alternatively or additionally be provided, including for example, the bearing system 38, the bearing system 38-1, and the bearing system 38-2.

The low speed spool 30 generally includes an inner shaft 40 that interconnects a fan 42, a low pressure (or first) compressor section 44 and a low pressure (or second) turbine section 46. The inner shaft 40 is connected to the fan 42 through a geared architecture 48 that can drive the fan shaft 98, and thus the fan 42, at a lower speed than the low speed spool 30. The geared architecture 48 includes a gear assembly 60 enclosed within a gear housing 62. The gear assembly 60 couples the inner shaft 40 to a rotating fan structure.

The high speed spool 32 includes an outer shaft 50 that interconnects a high pressure (or second) compressor section 52 and the high pressure (or first) turbine section 54. A combustor 56 is located between the high pressure compressor 52 and the high pressure turbine 54. A mid-turbine frame 57 of the engine static structure 36 is located generally between the high pressure turbine 54 and the low pressure turbine 46. The mid-turbine frame 57 supports one or more bearing systems 38 in the turbine section 28. The inner shaft 40 and the outer shaft 50 are concentric and rotate via the bearing systems 38 about the engine central longitudinal axis X-X', which is collinear with their longitudinal axes. As used herein, a "high pressure" compressor or turbine experiences a higher pressure than a corresponding "low pressure" compressor or turbine.

The core airflow is compressed by the low pressure compressor section 44 then the high pressure compressor 52, mixed and burned with fuel in the combustor 56, then expanded over the high pressure turbine 54 and the low pressure turbine 46. The mid-turbine frame 57 includes airfoils 59 which are in the core airflow path. The turbines 46, 54 rotationally drive the respective low speed spool 30 and high speed spool 32 in response to the expansion.

The gas turbine engine 20 is a high-bypass ratio geared aircraft engine. The bypass ratio of the gas turbine engine 20 may be greater than about six (6). The bypass ratio of the gas turbine engine 20 may also be greater than ten (10:1). The geared architecture 48 may be an epicyclic gear train, such as a star gear system (sun gear in meshing engagement with a plurality of star gears supported by a carrier and in meshing engagement with a ring gear) or other gear system. The geared architecture 48 may have a gear reduction ratio of greater than about 2.3 and the low pressure turbine 46 may have a pressure ratio that is greater than about five (5). The diameter of the fan 42 may be significantly larger than that of the low pressure compressor section 44, and the low pressure turbine 46 may have a pressure ratio that is greater than about five (5:1). The pressure ratio of the low pressure turbine 46 is measured prior to an inlet of the low pressure turbine 46 as related to the pressure at the outlet of the low pressure turbine 46. It should be understood, however, that the above parameters are examples of various embodiments of a suitable geared architecture engine and that the present disclosure contemplates other turbine engines including direct drive turbofans.

The next generation turbofan engines are designed for higher efficiency and use higher pressure ratios and higher temperatures in the high pressure compressor 52 than are conventionally experienced. These higher operating temperatures and pressure ratios create operating environments that cause thermal loads that are higher than the thermal loads conventionally experienced, which may shorten the operational life of current components.

Figure 2:
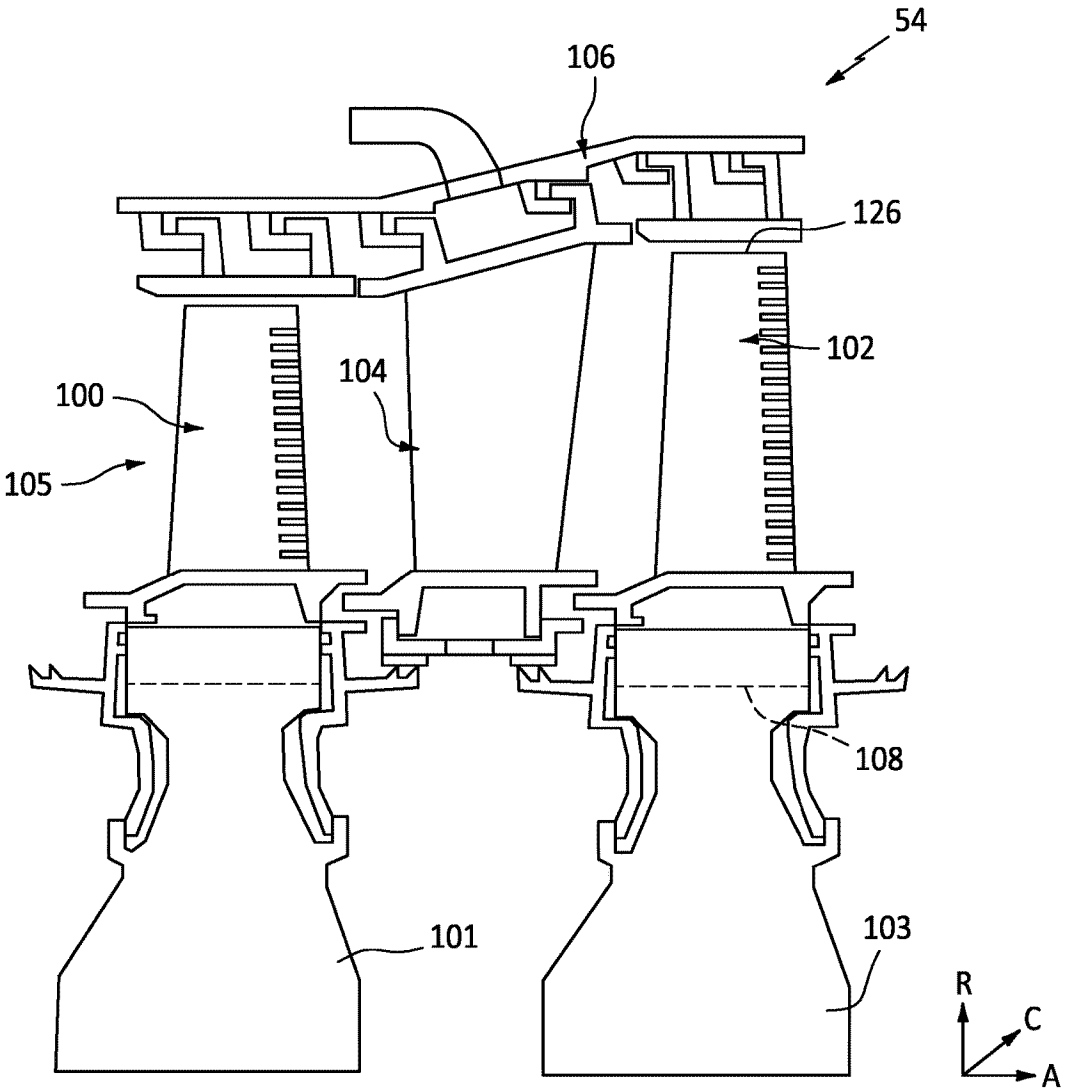
FIG. 2 is a cross-sectional view of a portion of a high pressure turbine section of the gas turbine engine of FIG. 1, in accordance with various embodiments.

Referring now to FIGS. 1 and 2, the high pressure turbine section 54 may include multiple blades 105 including multiple rows, or stages, of blades including a first blade 100 and a second blade 102, along with rows, or stages, of vanes located therebetween including a vane 104. The blades 100, 102 may be coupled to disks 101, 103 respectively which facilitate rotation of the blades 100, 102 about the axis X-X'. The vane 104 may be coupled to a case 106 and may remain stationary relative to the axis X-X'.

The blade 102 may include an inner diameter edge 108 (e.g., of an attachment root) and an outer diameter edge (e.g., an airfoil tip) 126. Due to relatively high temperatures within the high pressure turbine section 54, it may be desirable for the blade 102 (and the vane 104) to receive a flow of cooling air. In that regard, the blade 102 may receive a cooling airflow from the inner diameter edge 108 or the outer diameter edge 126. The blade 102 may define cavities that transport the cooling airflow through the blade 102 to the other of the inner diameter edge 108 or the outer diameter edge 110.

Improved cooling passages will be described throughout the disclosure with reference to the blade 102. However, one skilled in the art will realize that the cooling passage design implemented in the blade 102 may likewise be implemented in the vane 104, or any airfoil (including a rotating blade or stationary vane) in any portion of the compressor section 24 or the turbine section 28.

Figure 3:
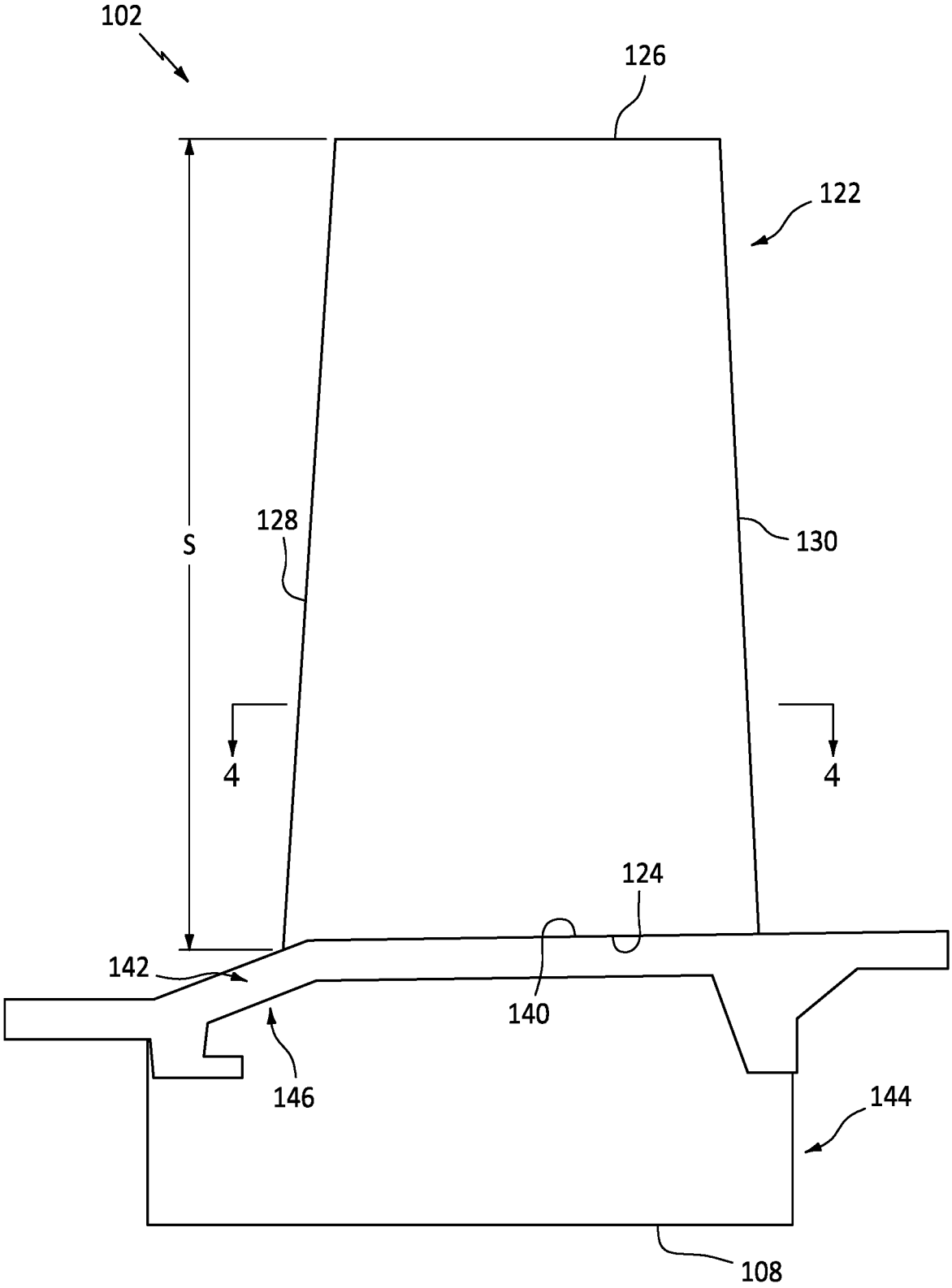
FIG. 3 is a schematic side view of a turbine blade for the high pressure turbine section of FIG. 2.

Turning now to FIG. 3, an engine turbine element 102 is illustrated as a blade (e.g., a high pressure turbine (HPT) blade) having an airfoil 122 which extends between an inboard end 124, and an opposing outboard end 126 (e.g., at a free tip), a spanwise distance or span S therebetween extending substantially in the engine radial direction. The airfoil also includes a leading edge 128 and an opposing trailing edge 130. A pressure side 132 (FIG. 4) and an opposing suction side 134 extend between the leading edge 128 and trailing edge 130.

The airfoil inboard end is disposed at the outboard surface 140 (FIG. 3) of a platform 142. An attachment root 144 (e.g., firtree) extends radially inward from the underside 146 of the platform.

The example turbine blade is cast of a high temperature nickel-based superalloy, such as a Ni-based single crystal (SX) superalloy (e.g., cast and machined). As discussed further below, an example of a manufacturing process is an investment casting process wherein the alloy is cast over a shelled casting core assembly (e.g., molded ceramic casting cores optionally with refractory metal core (RMC) components). Example ceramics include alumina and silica. The cores may be fired post-molding/pre-assembly. An example investment casting process is a lost wax process wherein the core assembly is overmolded with wax in a wax die to form a pattern for the blade. The pattern is in turn shelled (e.g., with a ceramic stucco). The shelled pattern (FIG. 5) is dewaxed and hardened (e.g., a steam autoclave dewax followed by kiln hardening or a kiln hardening that also vaporizes or volatilizes the wax). Thereafter, open space in the resulting shell casts the alloy.

The blade may also have a thermal barrier coating (TBC) system (not shown) along at least a portion of the airfoil. An example coating covers the airfoil pressure and suction side surfaces and the gaspath-facing surfaced of the platform. An example coating comprises a metallic bondcoat and one or more layers of ceramic (e.g., a YSZ and/or GSZ).

Figure 4:
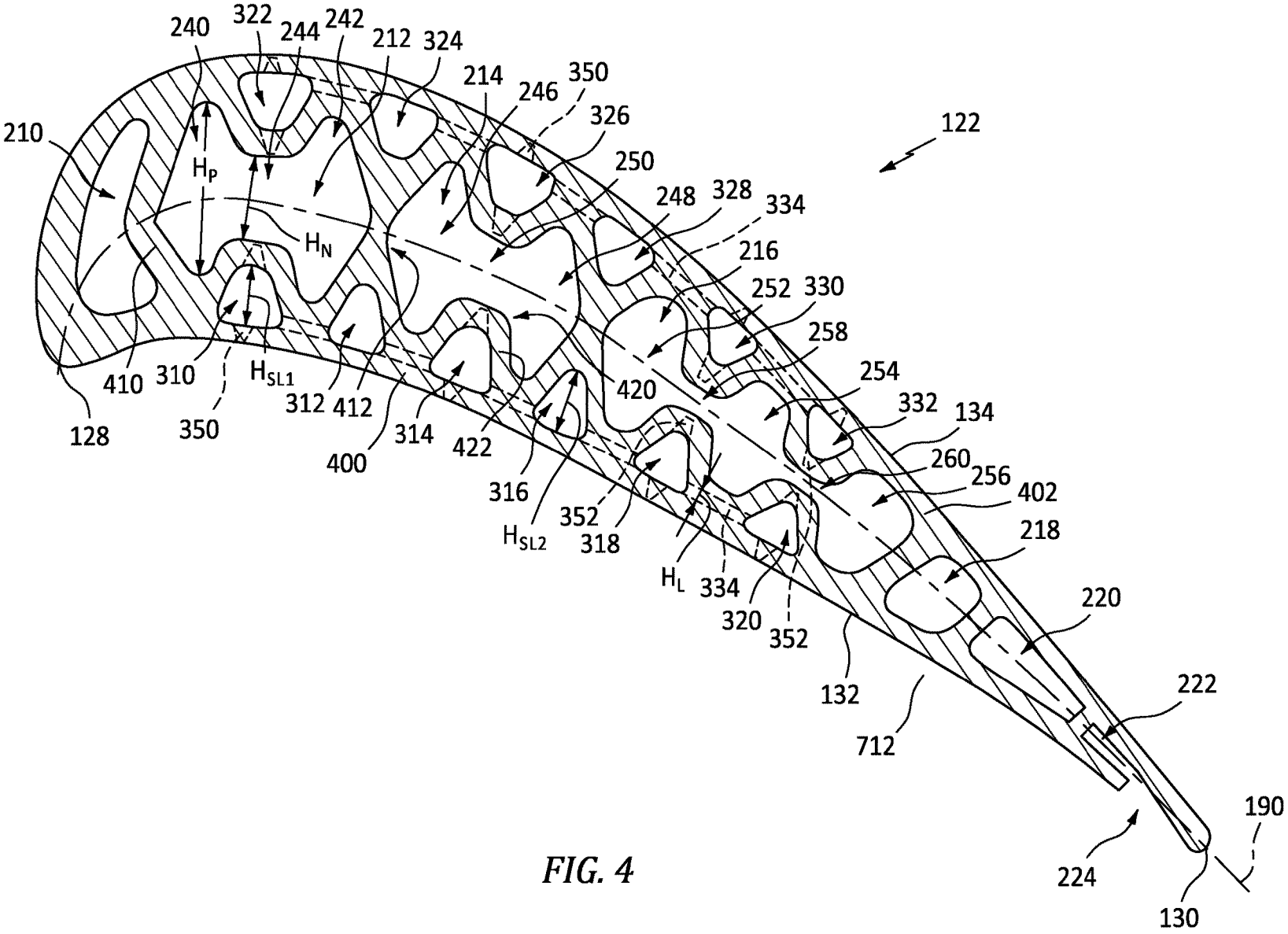
FIG. 4 is a transverse (generally tangential to the engine centerline) sectional view of an airfoil of the turbine blade of FIG. 3.

FIG. 4 also shows a camber line 190 in a transverse sectional view. FIGS. 4 et seq. are notional in how various features are shown or not shown relative to the involved cut planes. Where some broken line features represent details below the plane, other below-plane features may not be included for simplicity. Similarly, for purposes of illustration, in some situations, such as the sectional view of FIG. 6, features such as core bumpers are shown in plane, whereas, at least some would be expected to be out of plane. Three-dimensionally, the camber line is a mathematical surface formed by the camber lines along all the sequential sections. The blade has a cooling passageway system with a plurality of spanwise passageways (passageway legs/segments/sections) within the airfoil. These legs include a series of passageways straddling the camber line arrayed from upstream to downstream. These are main body passageways. These include a leading first passageway 210, a second passageway 212, a third passageway 214, a fourth passageway 216, a fifth passageway 218, and a sixth passageway 220. The sixth passageway may feed a discharge slot 222 having an outlet falling at or near the trailing edge (e.g., an outlet 224 shifted slightly to the pressure side in this example). The leading passageway 210 may be an impingement cavity fed by the second passageway 212.

As is discussed further below, the example passageways 212, 214, and 216 each have a multi-lobed structure with two or more protuberant sections/portions (protuberances or lobes) arrayed upstream to downstream and adjacent protuberant sections connected by an associated necked region/section/portion (neck). The main body passageways may be cast by one or more main body cores or feedcores having corresponding/complementary sections. Thus, for the multi-lobed passageways, the corresponding core(s) has/have associated sections (segments/legs) with similar protuberances (although formed as negatives) and necks wherein the necks are bounded by a pair of channels on opposite sides of the core section cross-section, the channels extending the length of the core section and having a base along the neck transitioning to sidewalls at inboard ends of the associated lobes.

Figure 5:
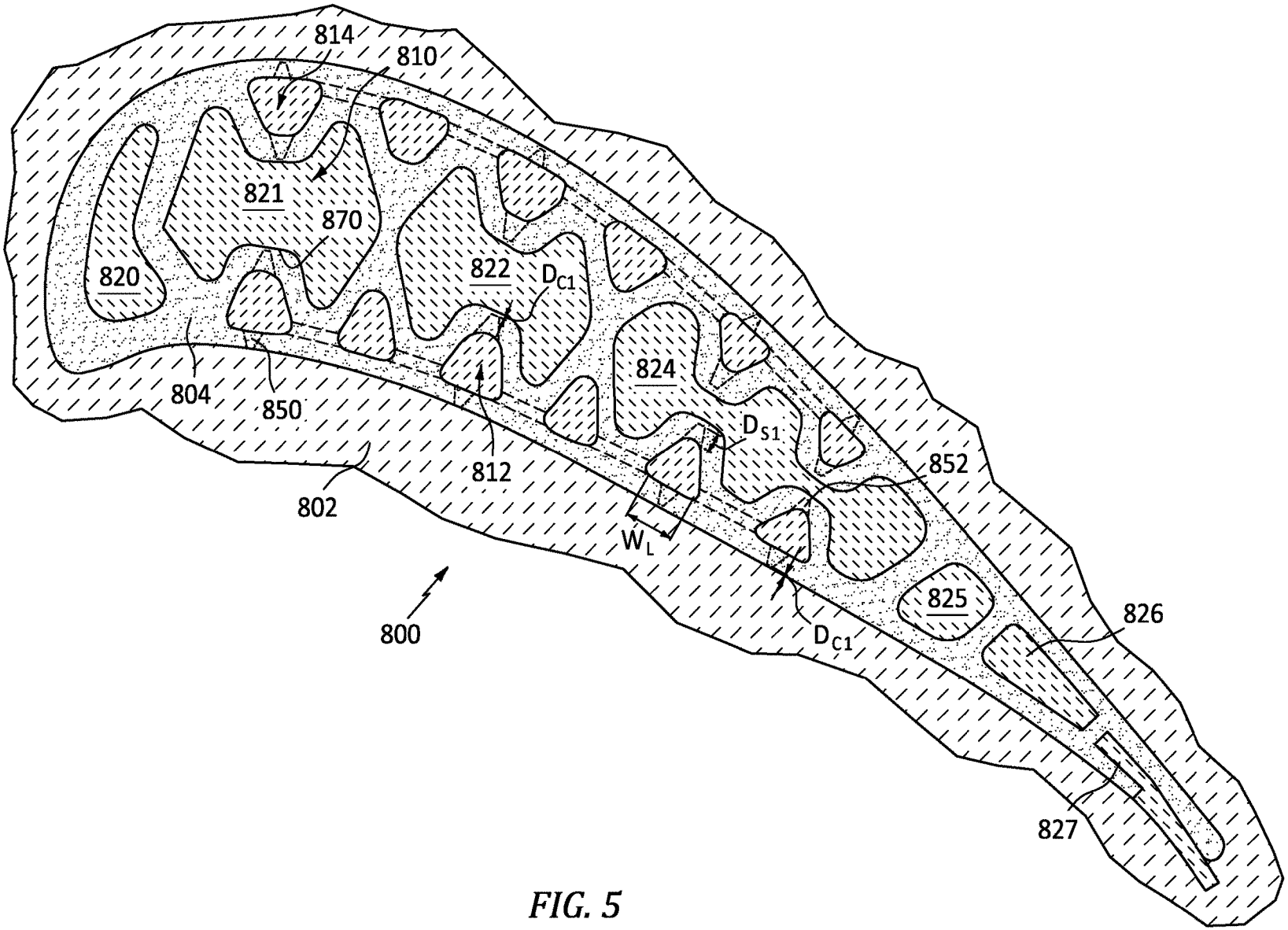
FIG. 5 is a cross-sectional view of a shelled pattern for casting the airfoil of FIG. 4.

FIG. 5 shows a shelled pattern 800 including a ceramic stucco shell 802 over pattern wax 804. The pattern wax was overmolded to a casting core assembly including a main body core or feedcore 810 and, as discussed further below, a pressure side skin core 812 and a suction side skin core 814. The example main body core is a single molded core having respective sections 820, 821, 822, 824, 825, 826, and 827 respectively complementary to the passageways 210, 212, 214, 216, 218, 220, and 222. An example number of the multi-lobed passageways and core sections is three, more broadly two to four or two to five. An example number of lobes per passageway and core section is two or three. More will likely reduce strength normal to the chordwise and spanwise directions. The example structure of necked region(s) and lobes extend over at least 50% of the airfoil span, more particularly at least 80%. This distance may preferably be a continuous uninterrupted distance.

Although the example main body core is a single piece, alternative multipiece combinations are possible. Among multipiece combinations, however, key combinations include the core sections that cast the multi-lobed passageways as a single piece with each other. As is discussed further below, the skin cores 812 and 814 may each be a single piece or otherwise an integral unit.

The example protuberant sections (passageway and core) have approximately a near rhomboid rounded corner convex quadrilateral cross-section/footprint with one corner of an opposite pair of corners near/pointing toward the suction side and the other corner near/pointing toward the pressure side. At least one corner of what would be the other pair of corners is replaced by the junction/merger with the adjacent neck approximately along the camber line (only one for a terminal protuberance such as those of a two-protuberance passageway and both for an intermediate protuberance such as the middle protuberance of a three protuberance passageway) so that the leading corner of one passageway is adjacent the trailing corner of another. The other corner of a terminal protuberance may fall approximately along the camber line so that the leading corner of one passageway is adjacent the trailing corner of another.

The example second passageway 212 (FIG. 4) has a forward or upstream protuberant section 240, an aft or downstream protuberant section 242, and an intermediate necked portion (neck section/portion or neck) 244. In this reference frame, upstream and downstream are viewed chordwise or streamwise (for the external gas flow) rather than relative to the internal airflow which would be into or out of the cut plane and are close to forward and aft. Similarly, the second passageway 214 has an upstream protuberant portion 246 and a downstream protuberant portion 248 connected by a necked portion 250. The example third passageway 216 has an upstream protuberant portion 252, a downstream protuberant portion 256, and an intermediate protuberant portion 254 with a necked portion 258 between the upstream portion and the intermediate portion, and a necked portion 260 between the intermediate portion and the downstream portion. Example neck thicknesses or heights $H_N$ (FIG. 4—at location of minimum thickness at a given spanwise location) are 10% to 60%, more narrowly 15% to 50% of adjacent lobe heights $H_P$.

Figure 4A:
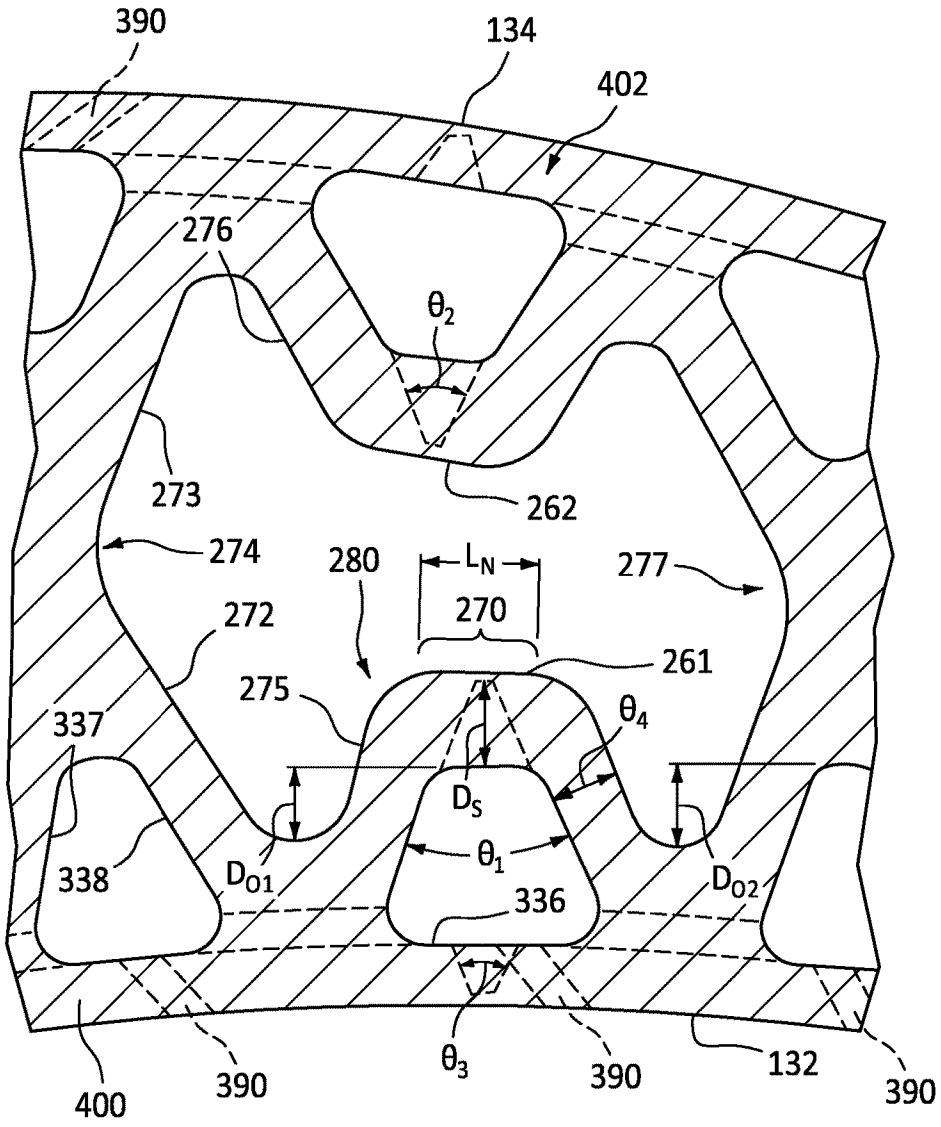
FIG. 4A is an enlarged view of a portion of the airfoil of FIG. 4.

FIG. 4A shows the necked portion having a pair of side surfaces 261, 262 near the pressure side and suction side, respectively. As discussed further below, each of these has a generally straight portion 270.

The protuberant portions have a leading pressure side surface having a generally straight portion 272 and a leading suction side surface having a generally straight portion 273. The straight portions are joined by an arcuate transition 274. The protuberances have trailing/aft pressure side surfaces having straight portions 275 and trailing/aft suction side surfaces having straight portions 276. For leading and intermediate protuberances, these merge with the adjacent necked portion. For trailing protuberances, these merge at an arcuate transition 277. There are outwardly concave/inwardly convex transitions 280 between these surfaces and the neck surfaces. The casting cores have corresponding negative surfaces.

The various spanwise passageways may connect to associated inlet ports 290 (FIG. 8) in the root and may connect to associated outlet ports along the airfoil lateral surface or at the tip.

In addition to these main body cooling passageways, the example blade includes a series of a plurality of generally spanwise suction side passageways (passageway legs/segments/sections) and a series of a plurality similar pressure side passageways (e.g., as disclosed generally in the '364 patent and '550 patent noted above). An example count per side is four to ten. The pressure side passageways include, from upstream to downstream and fore to aft, passageways (FIGS. 4) 310, 312, 314, 316, 318, and 320. In various implementations, the pressure side passageways may be cast by a single pressure side casting core (FIG. 5) 812 (skin core—e.g., molded ceramic). As artifacts of such casting, adjacent passageways may be connected by a spanwise distributed plurality of linking passageways 334 which are artifacts of core ties linking adjacent core sections which respectively cast the passageways. Similarly, the suction side passageways are, from fore to aft and streamwise upstream to downstream, passageways 322, 324, 326, 328, 330, and 332. And as with the other passageways, the suction side skin core 814 has similar/complementary sections with similar (but negative) surfaces. As is discussed further below, on each of the pressure side and suction side, a first group of the skin passageways nest with the adjacent neck (and between the lobes) of an adjacent associated main body passageway 212, 214, 216. Additionally, others may nest between two adjacent main body passageways. For purposes of differentiation, the former may be designated as intra-nesting and the latter as inter-nesting. Thus, the example inter-nesting passageways (312 and 316 on the pressure side and 324 and 328 on the suction side) nest between the associated pressure or suction side and the two adjacent main body passageways. The intra-nesting skin passageways are 310, 314, 318, and 320 on the pressure side and 322, 326, 330, and 332 on the suction side. To facilitate the nesting, the skin passageways and associated core sections may be of essentially rounded-corner triangular cross-section (e.g., as in the '364 patent) or otherwise similarly tapering depthwise inward (e.g., a rounded-corner trapezoidal cross-section/footprint). The base 336 (FIG. 4A) of the triangle or trapezoid falls adjacent to and essentially parallel to the adjacent pressure side or suction side surface spaced apart therefrom by a wall thickness. Forward 337 and aft 338 sides of the triangle or trapezoidal cross-section converge away from that side surface toward the camber line as do the complementary/associated surfaces of the casting cores (thus toward the associated neck for the intra-nesting passageways. There may be outlet passageways (e.g., drilled holes or electrodischarge machined (EDM) holes or cast holes (e.g., via RMC) 390 shown in FIG. 4A) from the respective pressure side and suction side passageways to the airfoil pressure side and suction side. As in the '550 patent, the pressure side passageways and suction side passageways may extend from inlet ports 340, 342 (FIG. 8) along the root. As in the '550 patent to accommodate the change in cross-section between root and airfoil, the cross-sectional shapes of the various passageways may transition between airfoil and root as may their nesting arrangement. The casting cores may similarly change.

As additional artifacts of manufacture the pressure side passageways and suction side passageways have outboard/outward projections 350 (FIG. 4) (e.g., toward the respective pressure side 132 or suction side 134) and inboard/inward projections 352 (e.g., toward the adjacent necked section). As is discussed further below, these projections 350 and 352 are artifacts of locating core projections (bumpers) integrally molded with the associated skin cores for the pressure side passageways and suction side passageways. Example core projections/bumpers (and thus the passageway projections they cast) are frustoconical optionally with a rounded distal end/tip. Example conical half angle for such bumpers is 15°-30°, more particularly, 20°-30° or 20°-25°. A height or protrusion of the bumpers (and thus depth of the passageway projection is shown as $D_{S1}$. The height $D_{S1}$ of the bumper is set by the wall thickness and desired clearance $D_{C1}$ (FIG. 5) and as such can range from an example 0.020 inch to 0.060 inch (0.51 mm to 1.5 mm), more broadly, 0.015 inch to 0.080 inch (0.38 mm to 2.0 mm). Alternative bumper and passageway projection footprints are elliptical or obround.

There may be non-uniform $D_{S1}$. For example, due to decreasing centrifugal loading stresses from platform to tip of a blade, wall thickness may decrease spanwise outward. Thus, projection height may similarly decrease. Also, the heights of the projections 850, 852, even at similar spanwise location may differ from each other. FIG. 4 also shows a depthwise height or span $H_L$ of the linking portions 334 (and thus the associated core ties). FIG. 4 also shows such heights $H_{SL1}$ for the intra-nesting passageways (and associated intra-nesting core sections/segments/legs) away from the projections or bumpers and a similar height $H_{SL2}$ for the inter-nesting skin passageways or core sections. In the illustrated example, the outboard surfaces of the linking skin passageway and core ties are essentially flush to the outboard face of the triangular section of the adjacent passageways or core sections. The linking portions' depthwise height $H_L$ is much less than the depthwise height $H_{SL1}$, $H_{SL2}$ of the skin passageways (e.g., an example 10% to 30% of the skin passageway height). The depthwise height $H_L$ is large enough to prevent the links from breaking during the casting process but low enough to not risk penetration with the adjacent main body passageway lobes. Example height $H_L$ is 0.015 inch to 0.040 inch (0.38 mm to 1.02 mm), more particularly, 0.020 inch to 0.030 inch (0.51 mm to 0.76 mm). Example outboard faces of the triangular section have flat portions of width $W_L$ (FIG. 5) which may be, as an example, at least 0.050 inch (1.27 mm) or 0.050 inch to 0.130 inch (1.27 mm to 3.30 mm).

The bumpers 850 (FIG. 5) that form the projections 350 initially register the associated cores and core assembly with the adjacent pressure side surface or suction side surface of the wax/die mold used to over mold pattern wax to the core assembly. They later may help maintain such positions in the shell during casting. The bumpers 852 that form the projections 352 may help maintain relative positions of the associated skin core and the main body core. In the illustrated example, each of the intra-nesting passageways has a plurality of the projections 350 and 352 spanwise-distributed. However, in other variations, less than all may have such projections. In the illustrated embodiment, none of the inter-nesting skin passageways have such projections. Projections 352 (or more particularly the associated core bumpers) would have no positioning function on the inter-nesting passageways and associated core sections. There could be a positioning function associated with having projections 350 from the inter-nesting passageways (due to positioning by the associated bumper). But this is expected to be redundant with the positioning capability offered by the bumpers 850 on the intra-nesting sections.

In example implementations, there are tolerances between the skin core bumpers 852 and the feedcore on the one hand and between the skin core bumpers 850 and adjacent surfaces of the wax die on the other hand. Example nominal (e.g., ideal centered) clearance is 0.0020 inch to 0.0050 inch (0.051 mm to 0.127 mm), more broadly 0.0020 inch to 0.010 inch (0.051 mm to 0.254 mm) in direct distance (clearance distance) $D_{C1}$ (FIG. 5). Where the clearance is maintained during overmolding and casting, there will be no associated full penetration of the subject wall (the pressure side wall or suction side wall for the cast projections 350 and the internal wall separating the skin passageways from the feed passageways for the cast projections 352). However, due to molding and assembly tolerance and other factors, it may be expected that some of the core bumpers 850 or 852, respectively, will contact the associated die surface or feedcore neck surface and this may result in a through-hole at the associated cast passageway projection 350, 352. However, the associated flow through that hole in the ultimate part would be expected to be tolerable. Effectively, a penetration of one of the projections 350 would add an additional film cooling hole, although not a well angled one. Similarly, a penetration of the passageway projection 352 would cause a minor flow leakage (if any) between the skin passageway and the feed passageway assuming differential restriction in the two had caused a pressure difference at the penetration.

In addition to positioning the cores in a direction approximately normal to the adjacent pressure side or suction side, the inboard/inward bumpers 852 help position the cores transverse thereto. Chordwise (camber-wise/streamwise) length of the neck section allows some differential chordwise/camber-wise/streamwise movement of the skin cores relative to the feedcore. The example passageway necked portion (neck) surfaces have essentially straight portions 270 (FIG. 4A) that span, as an example at least 0.030 inch (0.76 mm), more narrowly, 0.030 inch to 0.100 inch (0.76 mm to 2.54 mm). The associated feedcore necked portions have corresponding/complementary surfaces 870 of the same dimension. This allows such relative chordwise/camber-wise/streamwise movement. Thus, the associated bumper 852 may have approximately at least that span $L_N$ (FIG. 4A) of movement (the loss of range due to bumper tip thickness roughly offsets additional range near arcuate transitions from the associated surface 870). To this end, the example surfaces 270 and 870 may be close to parallel to the associated pressure side or suction side they face. Although theoretically, they may be exactly parallel, they may be advantageously slightly off-parallel to compensate for the anticipated direction of differential thermal expansion. Due to the arcuate nature of the pressure side or suction side and the associated skin core, differential thermal expansion of the skin core relative to the feedcore may cause the skin core to move slightly off-parallel to the associated pressure side or suction side of the shell and thus ultimate casting. An example angle is up to 15°, more narrowly up to 10°, over a span $L_N$ of at least 0.030 inch (0.76 mm). Chordwise/streamwise movement is particularly relevant due to differential thermal expansion. Because the chordwise/streamwise length of the skin cores and spanwise lengths of the skin cores is much greater than the thickness of the skin cores (e.g., between the tips/apexes of the inboard/inward bumpers and those of the outboard/outward bumpers), the dimensional effects of differential thermal expansion are much greater in the chordwise/streamwise direction and spanwise direction.

FIGS. 4 and 4A show various wall structures. In general, these include a pressure side wall 400 and a suction side wall 402. Between the passageways 210 and 212, a generally kinked wall 410 spans across the camber line with a bend/angle/turn approximately aligned with the camber line so as to define the adjacent surfaces of the passageway 212. A generally X-cross-section wall structure 412 exists between adjacent main body passageways with pressure side sections or wall segments of the X straddling the upstream and downstream faces of the associated skin passageways 312 and 316 on the pressure side and 324 and 328 on the suction side.

Additionally, channel like wall structures 420 separate the skin passageways 310, 314, 318, and 320 on the pressure side and 322, 326, 330, and 332 on the suction side from the neck and lobes of the adjacent main body passageways. In certain implementations, the surfaces of the legs or branches 422 of these wall structures 420 may diverge from each other in the inward direction normal to the adjacent surface 132 or 134. FIG. 4A shows this divergence as having an angle $\theta_4$ which may be in an example range of 3.0° to 10.0°, more particularly 4.0° to 6.0°. This divergence is an artifact of a corresponding divergence between the associated side surfaces of the skin core and protuberant lobe of the main body core. In order to provide the surface portion 870 (FIG. 5) with sufficient streamwise span, an angle $\theta_4$ greater than zero is appropriate. For example, if molding and flow factors influence the orientations of the sides of the skin core sections, having the sides of the protuberances being off-parallel thereto may be necessary to provide sufficient $L_N$. Said angle $\theta_4$ may exist over a radial span of at least 50 percent of the airfoil and, preferably over the entire overlapping spanwise dimension of the passageways within the airfoil. However, such angle may exist in discrete spanwise regions adjacent the projections or bumpers (e.g., over a radial/spanwise span/distance of at least 0.100 inch (2.54 mm), more narrowly 0.100 inch to 0.200 inch (2.54 mm to 5.1 mm) for each projection or bumper.

Additional considerations attend the depthwise penetration of the skin passageways so as to depthwise overlap with the adjacent main body passageways or passageway protuberances. FIG. 4A labels the depthwise overlap between an intra-nesting skin passageway and the protuberant portions of the associated main body passageway as $D_{O1}$. FIG. 4A also shows such overlap of the inter-nesting skin passageways with the adjacent protuberances of the two adjacent main body passageways as $D_{O2}$. These depths of overlap serve to provide flexibility to reduce stress associated with differential thermal expansion. In operation, there is a thermal gradient from outside inward with the outside being hotter. Operationally, this may cause the airfoil to grow axially/streamwise and contract circumferentially or normal to the chord or camber line. See generally, the '550 patent. The overlap allows a hinging/collapse of the walls to permit this accommodation. Example $D_{O1}$ and $D_{O2}$ are at least 0.030 inch (0.76 mm), more particularly, 0.030 inch to 0.200 inch (0.76 mm to 5.08 mm), more particularly, 0.030 inch to 0.090 inch (0.76 mm to 2.3 mm). They may be in such range over at least 50% of (more narrowly at least 70% of) an airfoil span. Particularly for a blade, they may also be within such range over at least 70% of (more narrowly 90% of) the inboard 50% of (more narrowly 70% of) the airfoil span. It is more important to have the overlap in the ID portion of the blade (vs. a vane) because of the extra pull coming from rotation. There is no maximum $D_{O1}$ and $D_{O2}$ except as constrained by the airfoil size. In general, the more overlap the better. The overlap is influenced by the amount of allotted cooling flow and corresponding cavity areas required to meet the heat transfer needs.

Figure 6:
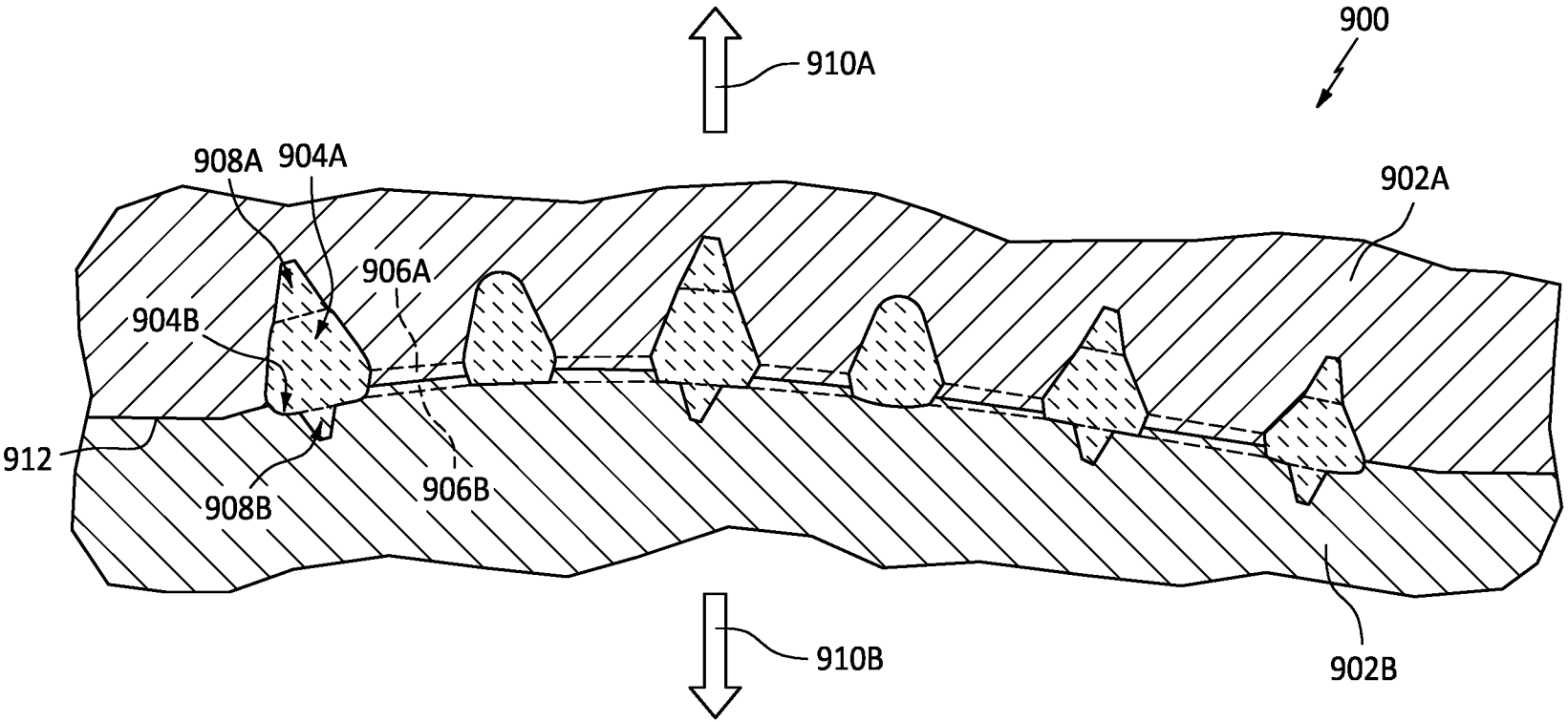
FIG. 6 is a partially schematic sectional view of a die for casting a pressure side skin core of the pattern of FIG. 5.
Figure 7:
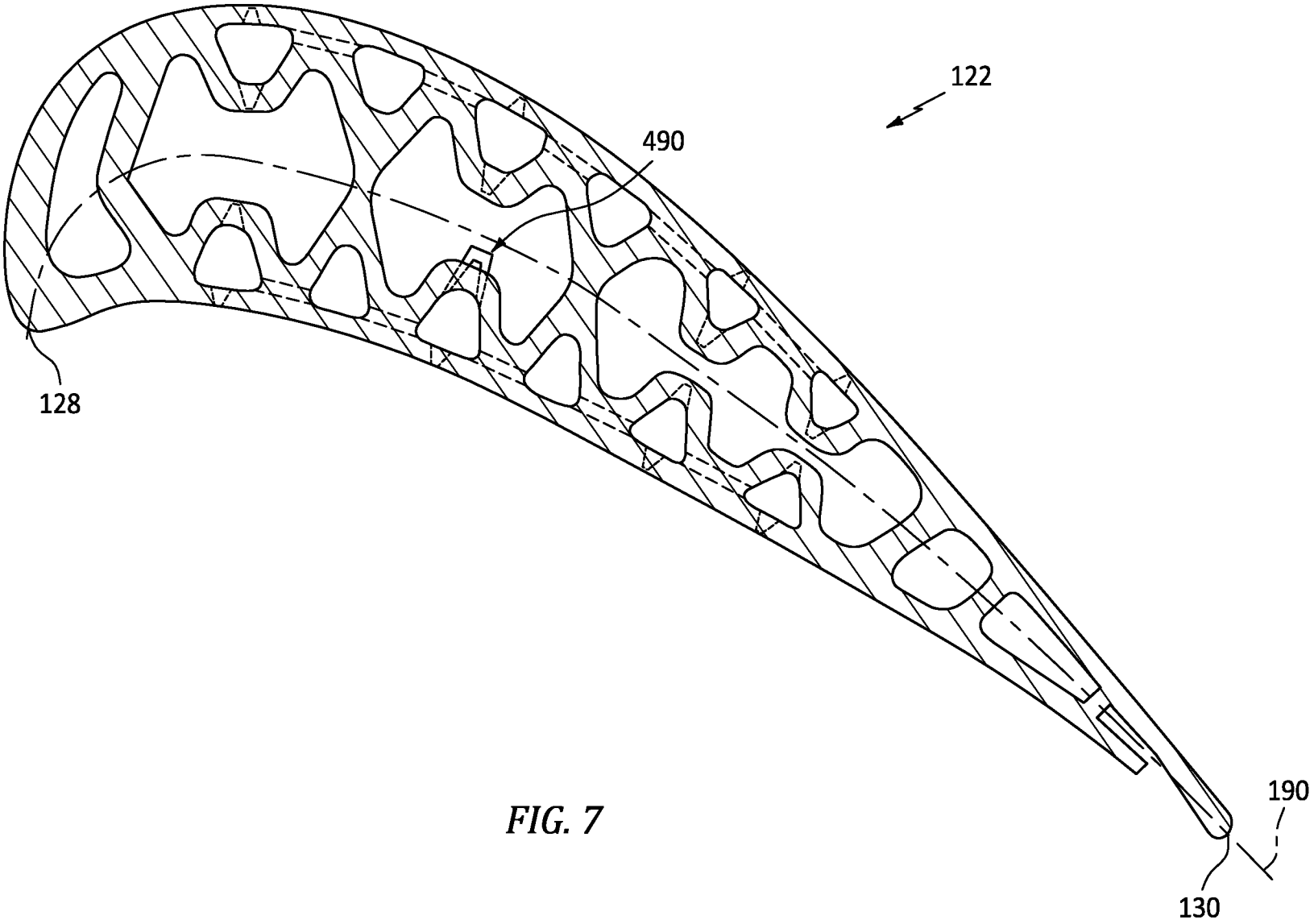
FIG. 7 is a sectional view of a second embodiment of or at a second location on a blade as a variation of FIG. 4.
Figure 7A:
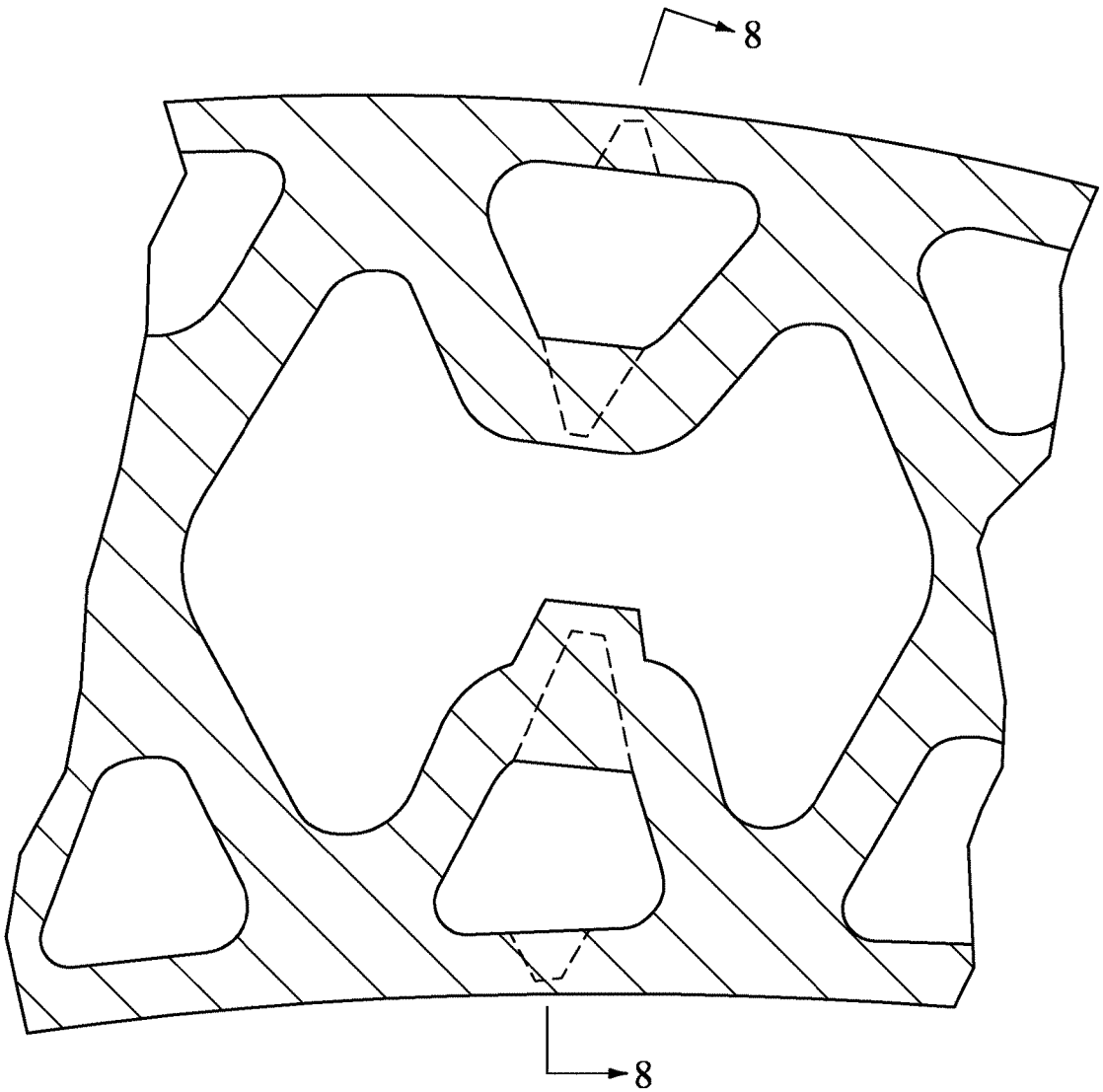
FIG. 7A is an enlarged view of the blade of FIG. 7.

FIG. 6 shows a die 900 having die halves 902A, 902B for molding the pressure side skin core. A similar die would mold the suction side skin core. A die pull direction is shown as 910A, 910B. The die half 902A has compartment sections 904A and 906A for molding the respective inboard portions of the sections and the core ties (links) that interlink them. The die half 902B has compartment sections 904B and 906B for molding the respective outboard portions of the passageways and the core ties that interlink them. Projections 908A, 908B of the compartments mold the corresponding core bumpers.

A die parting line 912 is located so that the two die halves can release when removed (pulled apart) in the die pull direction without backlocking with the skin core (backlocking would create a ceramic core die lock preventing die opening without risking damage to the core). To avoid such backlocking, it is seen that the angle of the lateral surfaces of the sections and of their bumpers do not go over-center relative to the pull direction for either of the die halves. Preferably, such surfaces are at least 1.0° off parallel to the pull directions to prevent die lock. U.S. Pat. No. 7,141,812 (the '812 patent) of Appleby et al., Nov. 28, 2006, "Devices, methods, and systems involving castings", U.S. Pat. No. 9,272,324 (the '324 patent) of Merrill et al., Mar. 1, 2016, "Investment casting process for hollow components", and U.S. Pat. No. 10,207,315 (the '315 patent) of Appleby et al., Feb. 19, 2019, "Systems, devices, and/or methods for manufacturing castings" disclose methods to make hard tooling for molding elastomeric/flexible molds that can be used to mold ceramic casting cores. Such a method is known under the trademark TOMO of Mikro Systems, Inc. of Charlottesville, VA The disclosures of the '812, '324, and '315 patents are incorporated by reference herein in their entireties as if set forth at length. If such flexible molds are used instead of a metallic mold, some backlocking may be accommodated by mold flexing when releasing the green ceramic.

In aspects shown in an embodiment of FIGS. 7-10 that further addresses these aspects of differential thermal expansion, a single inward/inboard core projection (bumper) 852A (FIG. 9) or a very small number per skin core may have a much reduced chordwise/camber-wise/streamwise and/or spanwise clearance effectively pinning the skin core to the feedcore at that location and allowing differential thermal expansion to occur progressively away from that location. Thus, for example, if a pinned location is close to the center of the footprint of the skin core, the maximum displacement due to differential thermal expansion will be half what it would have been in a situation where other circumstances caused pinning near the periphery of the footprint. An example pinned location is within a streamwise middle third of the skin core to provide such minimization of the peak effects of differential thermal expansion. However, an example spanwise location is within a spanwise outboard quarter, particularly when, as discussed below, the associated bumper is not involved in spanwise pinning/restraint.

Figure 9:
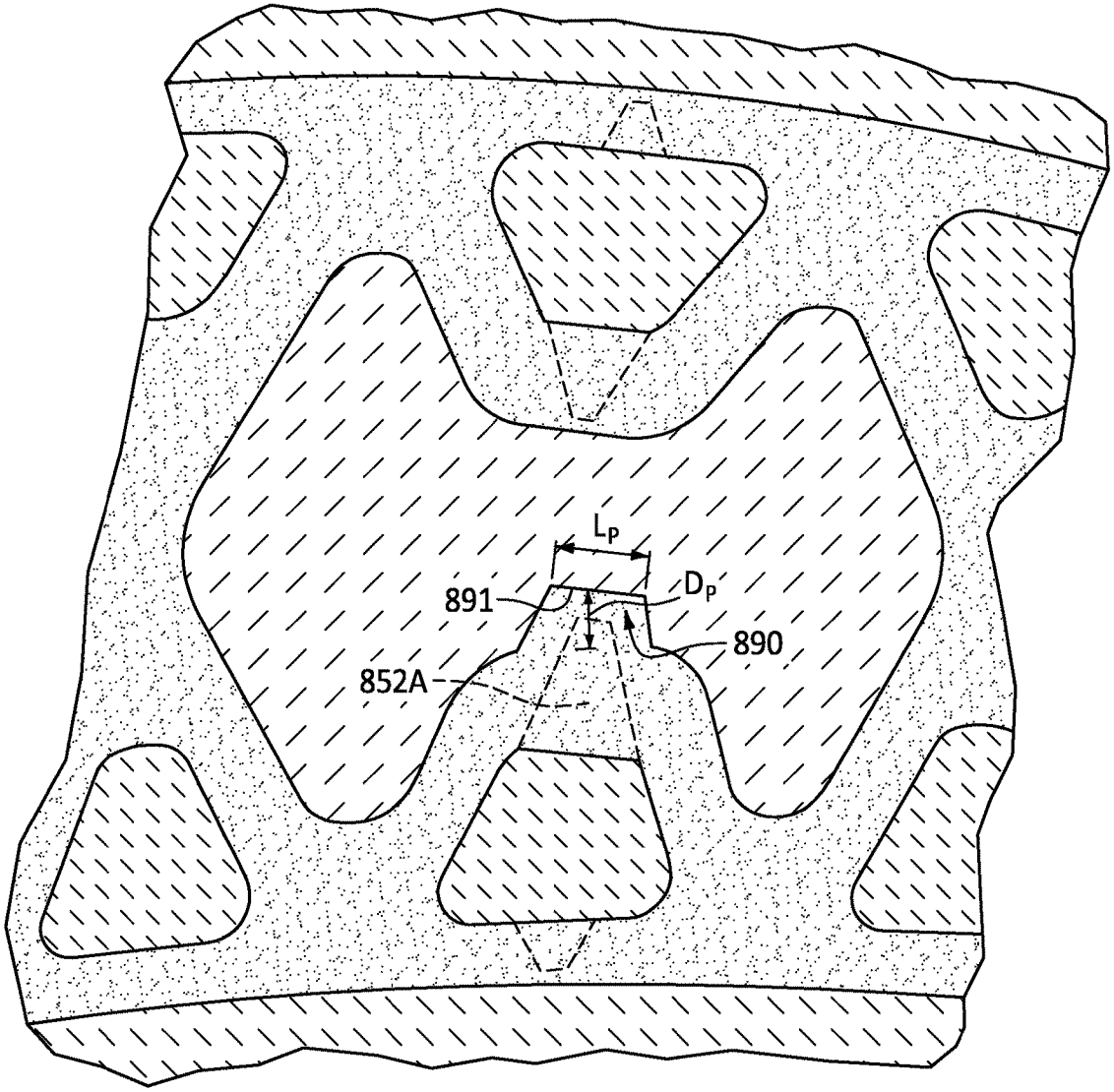
FIG. 9 is a cross-sectional view of a shelled pattern for casting the airfoil of FIG. 7.
Figure 10:
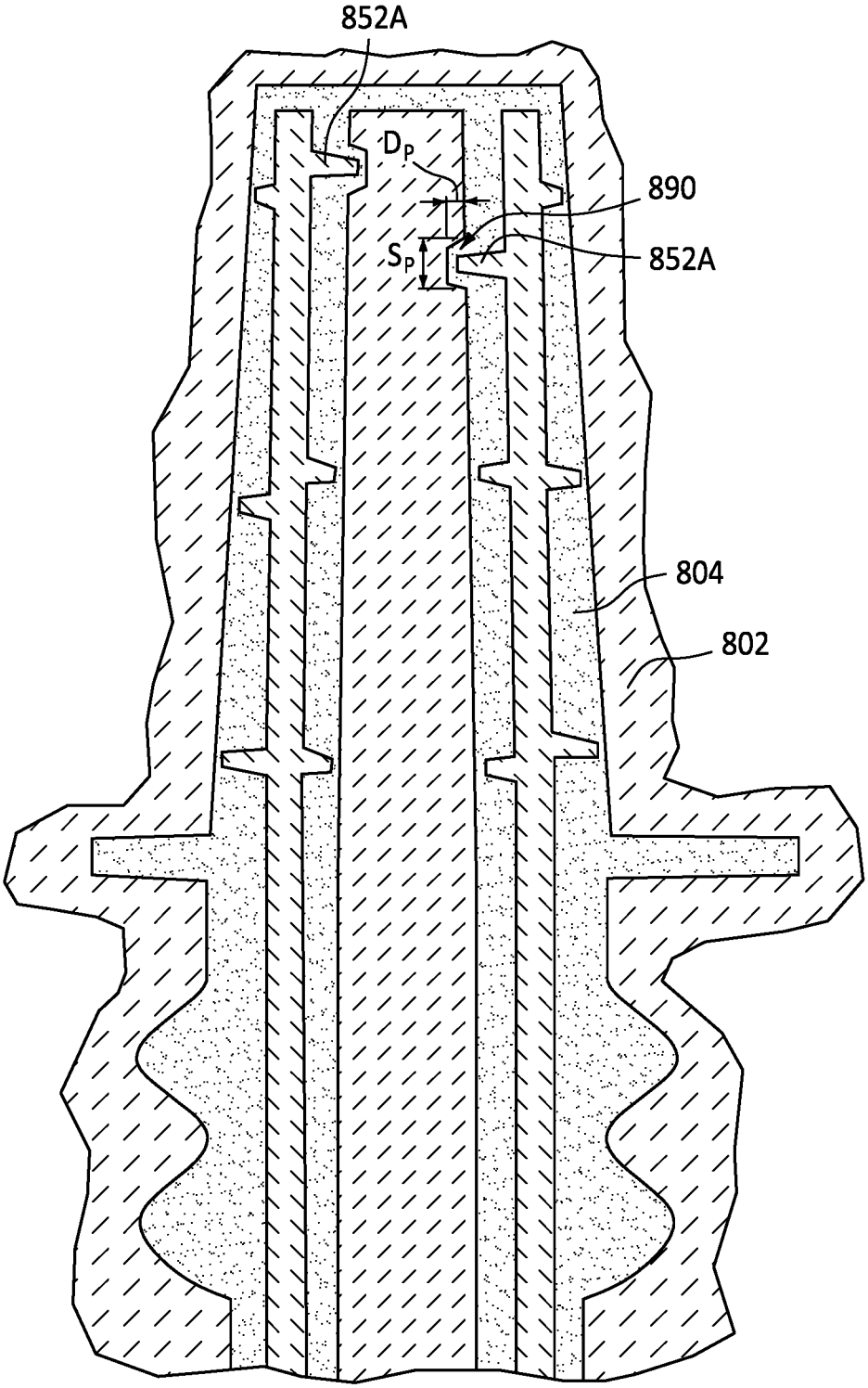
FIG. 10 is a cross-sectional view of a shelled pattern for casting the blade of FIG. 8.

Thus, FIG. 9 shows a much reduced chordwise/streamwise clearance of the inboard core bumpers of the respective skin cores near the chordwise/streamwise/axial middle of the footprint of the skin cores (only showing it for the pressure side although the suction side may similarly be clearance reduced). In this example, the reduced tolerance is associated with a relative increase in the protrusion of the bumper into a small pocket 890 (FIG. 9) added along the otherwise adjacent flat neck surface. A relatively flat base 891 of the small pocket may be much smaller in span $L_P$ (FIG. 9) than those $L_N$ of the neck flat portions noted above (e.g., half the chordwise/streamwise span or less than the remaining clearances). FIG. 10 shows the pockets 890 as having a vertical/spanwise/radial extent $S_P$. Depending on implementation, this may be chosen for different purposes. In an example situation, the main body cores and skin cores protrude past the inner diameter end of the ultimate root and are embedded in shell. In this case, there is essentially no need to otherwise spanwise register the cores and the spanwise clearance provided by $S_P$ may be sufficient to avoid any contact. In other situations, where there is not the same external registration of cores, the clearance/tolerance provided by $S_P$ may be closer to that afforded by the $L_P$ length.

Figure 8:
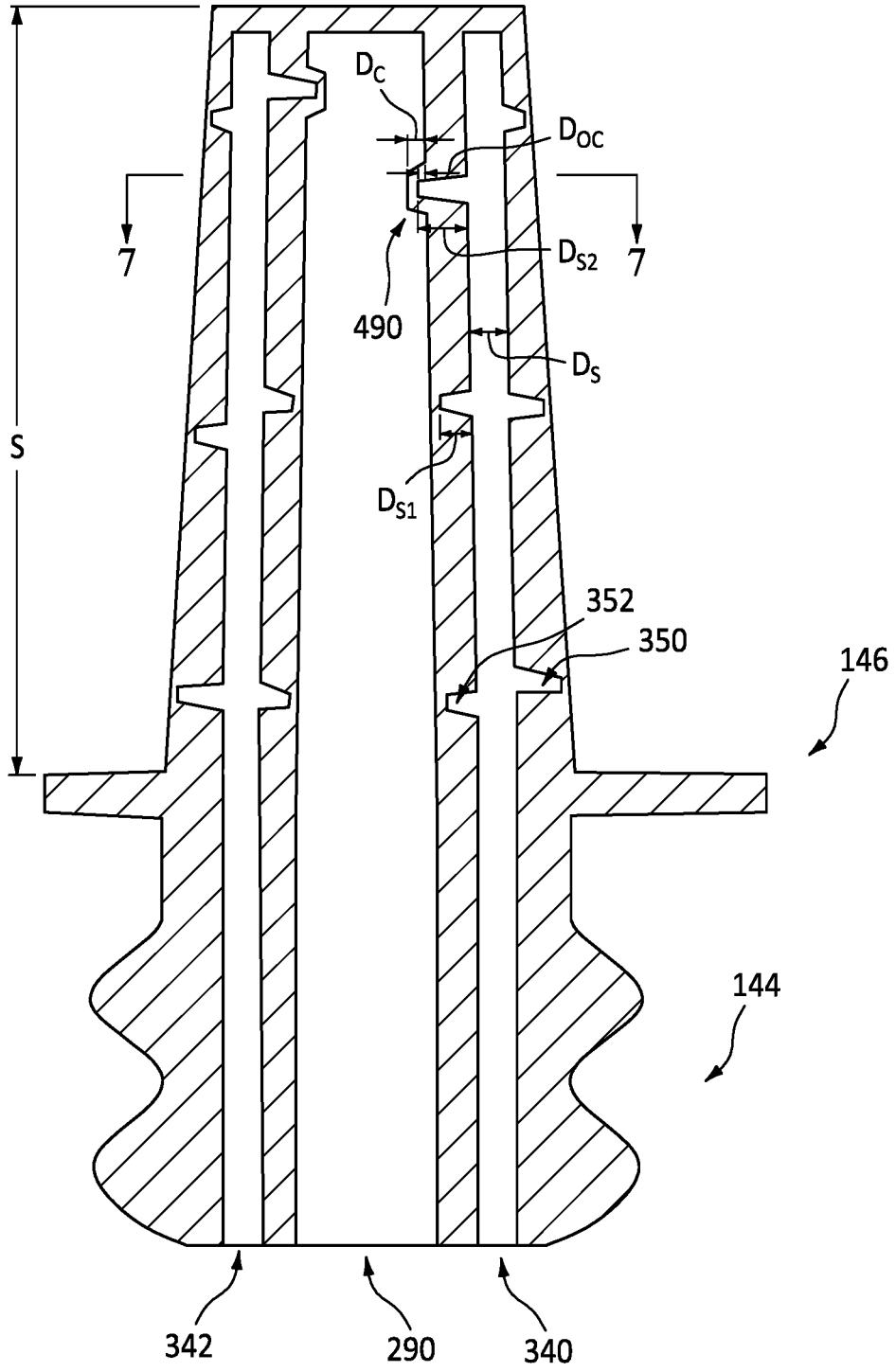
FIG. 8 is a radial sectional view facing generally aft/chordwise/camber-wise/streamwise downstream of the blade of FIG. 7.

FIG. 8 shows pocket 890 depth as $D_C$ and nominal protrusion of the associated bumper into the pocket as $D_{OC}$. Example $D_C$ is 0.015 inch to 0.050 inch (0.38 mm to 1.27 mm), more particularly, 0.015 inch to 0.025 inch (0.38 mm to 0.635 mm). Example nominal $D_{OC}$ is at least 0.010 inch (0.25 mm), more particularly 0.010 inch to 0.045 inch (0.25 mm to 1.14 mm), more particularly, 0.010 inch to 0.020 inch (0.25 mm to 0.51 mm). A height or protrusion of the bumper is shown as $D_{S1}$ and $D_{S2}$. Example $D_{S2}$ is at least 30% greater than $D_{S1}$ (e.g., an example 0.012 inch (0.305 mm) or more). Because wall thicknesses may decrease toward the tip, the protrusion (core bumper and passageway projection heights) may generally spanwise decrease. Thus, the greater protrusion may be only relative to other spanwise nearby bumpers and passageway projections. For example, the relatively greater protrusion may be relative the other second bumpers and associated passageway projections within a radial distance of 20%, or alternatively 10%, of the airfoil span therefrom.

FIG. 8 shows the feedcore pockets as each casting a protrusion/projection 490 into the associated passageway.

Figure 11:
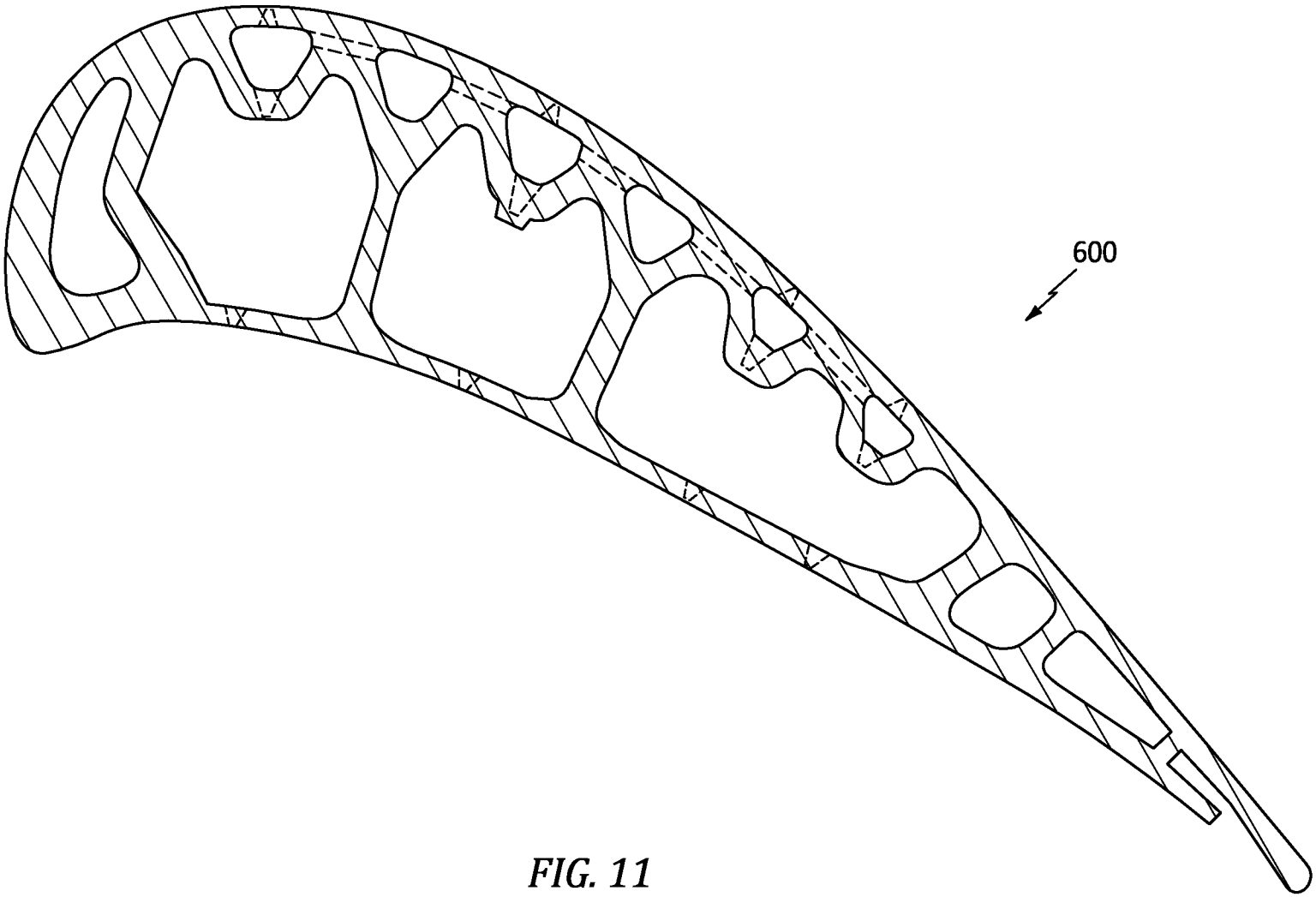
FIG. 11 is a transverse (generally tangential to the engine centerline) sectional view of an alternate airfoil of the turbine blade of FIG. 3.
Figure 12:
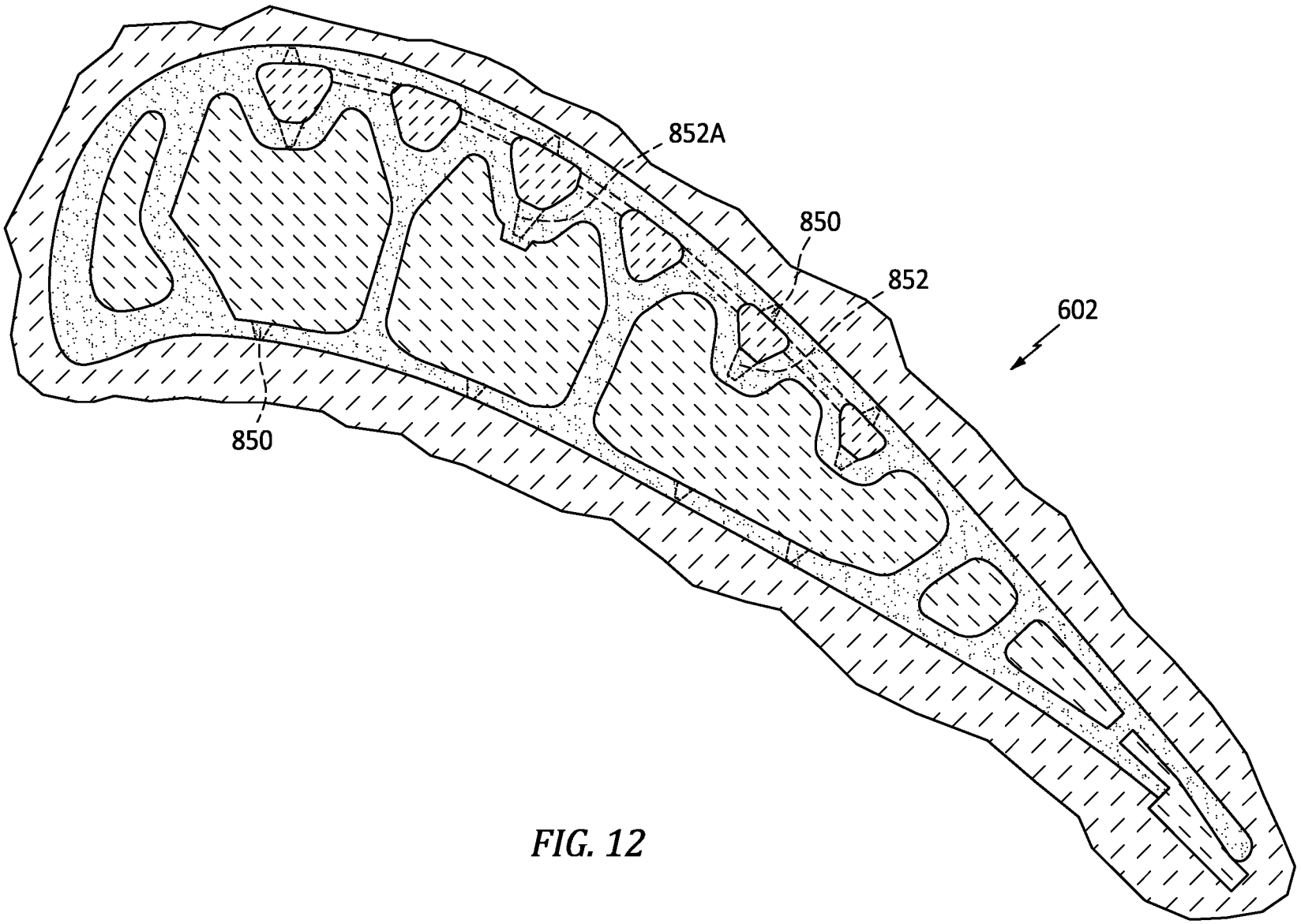
FIG. 12 is a cross-sectional view of a shelled pattern for casting the airfoil of FIG. 11.

FIG. 11 depicts the configuration of an alternative airfoil 600 for a blade or vane and FIG. 12 depicts the associated shelled pattern 602. In this example, there are nesting skin passageways (and thus a nesting skin core) only on the suction side. In this example, the main body passageways (and associated main body core) are in close proximity to the pressure side to internally bound the pressure side wall. In this embodiment, the necking is only on the suction side of the main body passageways/core segments. Example neck thicknesses or heights (at location of minimum thickness at a given spanwise location) are 10% to 80% more narrowly 10% to 60% or 15% to 50% or 30% to 80% or 50% to 80% of adjacent lobe heights.

In this example, the pressure sides of the main body core segments each have their own one or more bumpers 850 (FIG. 12—e.g., a spanwise plurality of bumpers) that cast associated passageway projections into the pressure side wall.

In this example, the intra-nesting core segment closest to the streamwise/chordwise/axial middle of the skin core bears the bumper 852A that is relatively chordwise/streamwise/axially constrained in the small pocket 890. Similarly, the associated feed passageway in the cast part has the inward protrusion/projection 490 (FIG. 11).

Although FIGS. 11 & 12 show the skin passageway/core on the suction side and the lobed main body passageways/core on the pressure side, it will be understood that other embodiments may have the skin passageway/core on the pressure side and the lobed main body passageways/core on the suction side.

Component materials and manufacture techniques and assembly techniques may be otherwise conventional.

Relative to configurations such as the '364 patent, the engagement of bumpers with the necks helps decouple movements and reduce core stresses. Core shrinkage and other slight shape changes upon firing/drying contribute to interference. Even if anticipated shrinkage is factored in so that nominal cores would perfectly nest/assemble, there will be variation from nominal. Additionally, there is differential thermal expansion during the casting process. If a bumper on an angled surface of a skin core segment as in the '364 patent interferingly contacts the angled surface of a main body core segment, it will tend to push the two apart both along the axial and chordwise directions and normal thereto (e.g., the circumferential direction). This may cause excessive variation in the overlaps $D_{O1}$ and $D_{O2}$ and in the thicknesses of adjacent walls. This may also cause stresses in the skin cores that may break the core ties.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

One or more embodiments have been described. Nevertheless, it will be understood that various modifications may be made. For example, when applied to an existing baseline configuration, details of such baseline may influence details of particular implementations. Although illustrated in the context of a blade, the basic cores and methods may be used to provide similar passageways in other articles. As noted above, this includes other forms of blades as well as vanes. Additionally, such cores may be used to cast such passageways in non-airfoil elements. One example is struts that extend through the gaspath. Additional modifications may be made for yet further different elements such as blade outer airseals (BOAS). In an example BOAS, the cores (and resulting passageways) may extend circumferentially or longitudinally relative to the ultimate position of the BOAS in the engine. For example, the base of a triangular skin core segment/section/leg may fall along the OD surface of an ID wall of the BOAS. In such a situation, a second skin core may be more radially outboard or may be deleted altogether. Accordingly, other embodiments are within the scope of the following claims.

What is claimed is:

1. A turbine engine airfoil element comprising:

an airfoil having:

a pressure side and a suction side; and a plurality of spanwise passageways including:

a plurality of main body passageways along a camber line and having two or more chordwise distributed protuberant portions and necks between the two or more chordwise distributed protuberant portions; and a plurality of skin passageways including:

at least one first skin passageway each nested between a first of the pressure side and the suction side and two adjacent main body passageways; and a plurality of second skin passageways each nested between said first of the pressure side and the suction side and two said protuberant portions of a corresponding main body passageway, wherein:

the necks extend over at least 50% of a span of the airfoil;

the necks have a section within 10° of parallel to the adjacent first of the pressure side and the suction side and having an axial length $L_N$ between the airfoil leading edge and trailing edge of at least 0.030 inch (0.76 mm); and the second skin passageways have a pair of side surfaces forming respective walls with adjacent surfaces of the associated protuberant portions, said walls having a central section diverging in thickness toward the camber line of the airfoil by an angle $\theta_4$ of 3.0° to 10.0°.

2. The turbine engine airfoil element of claim 1 wherein:

viewed normal to the first of the pressure side and the suction side, each skin passageway overlaps its adjacent main body passageway depthwise.

3. The turbine engine airfoil element of claim 1 wherein:

the first of the pressure side and the suction side is the suction side so that the plurality of skin passageways are suction side passageways; and the plurality of spanwise passageways further include:

a plurality of pressure side passageways including:

at least one first pressure side passageway each nested between the pressure side and two adjacent main body passageways; and a plurality of second pressure side passageways each nested between the pressure side and two said protuberant portions of a corresponding main body passageway.

4. The turbine engine airfoil element of claim 3 wherein:

the pressure side passageways and the suction side passageways have rounded-corner triangular cross-section.

5. The turbine engine airfoil element of claim 3 wherein:

each of the protuberant portions has a rounded-corner quadrilateral planform.

6. The turbine engine airfoil element of claim 3 wherein:

adjacent pressure side passageways connect to each other via a plurality of linking passageways;

adjacent suction side passageways connect to each other via a plurality of linking passageways; and the linking passageways extend less deeply into the airfoil cross-section than do the adjacent pressure or suction side passageways.

7. The turbine engine airfoil element of claim 3 wherein:

multiple of the second pressure side passageways and multiple of the second suction side passageways have:

one or more outboard projections into the respective pressure side wall or suction side wall; and one or more inboard projections into a wall shared with the associated neck.

8. The turbine engine airfoil element of claim 3 being a blade having an attachment root:

the main body passageways extend from respective inlets at an inner diameter (ID) end of the attachment root; and the first and second pressure side passageways and first and second suction side passageways extend from respective inlets at the inner diameter (ID) end of the attachment root.

9. A turbine engine including the turbine engine airfoil element of claim 3.

10. A method for manufacturing the turbine engine airfoil element of claim 3, the method comprising:

forming an assembly by assembling to each other:

a ceramic feedcore having sections for forming the plurality of main body passageways;

a ceramic pressure side skin core having sections for forming the plurality of pressure side passageways; and a ceramic suction side skin core having sections for forming the plurality of suction side passageways;

overmolding the assembly with a fugitive;

shelling the fugitive to form a shell;

casting alloy in the shell; and deshelling and decoring the cast alloy.

11. The turbine engine airfoil element of claim 1 wherein:

the turbine engine airfoil element is a blade having an attachment root.

12. The turbine engine airfoil element of claim 7 wherein:

the main body passageways extend from respective inlets at an inner diameter (ID) end of the attachment root; and the first and second skin passageways extend from respective inlets at the inner diameter (ID) end of the attachment root.

13. A turbine engine airfoil element comprising:

an airfoil having:

a pressure side and a suction side; and a plurality of spanwise passageways including:

a plurality of main body passageways along a camber line and having two or more chordwise distributed protuberant portions and necks between the two or more chordwise distributed protuberant portions; and a plurality of skin passageways including:

at least one first skin passageway each nested between a first of the pressure side and the suction side and two adjacent main body passageways; and a plurality of second skin passageways each nested between said first of the pressure side and the suction side and two said protuberant portions of a corresponding main body passageway, wherein:

multiple of the second skin passageways have:

one or more outboard projections into the first of the pressure side wall and the suction side wall; and one or more inboard projections into a wall shared with the associated neck.

14. The turbine engine airfoil element of claim 13 wherein:

the first of the pressure side and the suction side is the suction side so that the plurality of skin passageways are suction side passageways; and the plurality of spanwise passageways further include:

a plurality of pressure side passageways including:

at least one first pressure side passageway each nested between the pressure side and two adjacent main body passageways; and a plurality of second pressure side passageways each nested between the pressure side and two said protuberant portions of a corresponding main body passageway.

15. The turbine engine airfoil element of claim 14 wherein:

multiple of the second skin passageways have:

one or more outboard projections into the pressure side wall; and one or more inboard projections into a wall shared with the associated neck.

16. The turbine engine airfoil element of claim 14 wherein:

viewed normal to the first of the pressure side and the suction side, each skin passageway overlaps its adjacent main body passageway depthwise.

17. The turbine engine airfoil element of claim 14 wherein:

the pressure side passageways and the suction side passageways have rounded-corner triangular cross-section.

18. The turbine engine airfoil element of claim 14 wherein:

each of the protuberant portions has a rounded-corner quadrilateral planform.

19. A turbine engine including the turbine engine airfoil element of claim 13 as a blade having an attachment root.

20. The turbine engine including the turbine engine airfoil element of claim 19 wherein:

the main body passageways extend from respective inlets at an inner diameter (ID) end of the attachment root; and the first and second skin passageways extend from respective inlets at the inner diameter (ID) end of the attachment root.

* * * * *